US010678158B2

(12) United States Patent
Kikuchi et al.

(10) Patent No.: US 10,678,158 B2
(45) Date of Patent: Jun. 9, 2020

(54) ELECTRO-CONDUCTIVE MEMBER FOR ELECTROPHOTOGRAPHY, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Yuichi Kikuchi, Susono (JP); Kazuhiro Yamauchi, Suntou-gun (JP); Kenji Takashima, Numazu (JP); Masahiro Kurachi, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 147 days.

(21) Appl. No.: 15/702,075

(22) Filed: Sep. 12, 2017

(65) Prior Publication Data

US 2018/0088483 A1 Mar. 29, 2018

(30) Foreign Application Priority Data

Sep. 26, 2016 (JP) ..... 2016-187635
Aug. 10, 2017 (JP) ..... 2017-156049

(51) Int. Cl.
*G03G 15/02* (2006.01)
*G03G 21/18* (2006.01)

(52) U.S. Cl.
CPC ..... *G03G 15/0233* (2013.01); *G03G 21/18* (2013.01)

(58) Field of Classification Search
CPC ..... G03G 15/0233; G03G 21/18
See application file for complete search history.

(56) References Cited

U.S. PATENT DOCUMENTS

| | | | |
|---|---|---|---|
| 7,799,398 | B2 | 9/2010 | Nakamura et al. |
| 8,298,670 | B2 | 10/2012 | Muranaka et al. |
| 8,449,975 | B2 | 5/2013 | Hirakoso et al. |
| 8,503,916 | B2 | 8/2013 | Anan et al. |
| 8,628,854 | B2 | 1/2014 | Yamauchi et al. |

(Continued)

FOREIGN PATENT DOCUMENTS

| | | | |
|---|---|---|---|
| JP | 2004-37786 | A | 2/2004 |
| JP | 2006-91495 | A | 4/2006 |

(Continued)

OTHER PUBLICATIONS

Pages 89 to 91 of "Radiation and Polymer" by Kenichi Shinohara et al. (Maki Shoten, published in 1968) (Discussed at specification paragraphs [00110 and 00141].

*Primary Examiner* — Victor S Chang
(74) *Attorney, Agent, or Firm* — Venable LLP

(57) ABSTRACT

Provided is an electro-conductive member including: an electro-conductive support; and a surface layer, in which: the surface layer has a three-dimensionally continuous skeleton and has pores communicating in a thickness direction thereof, and when an arbitrary 150-micrometer square region of the surface of the surface layer is equally divided into 3,600 squares, the number of squares each including a through-hole is 100 or less; the skeleton is non-electro-conductive; the skeleton includes a plurality of resin particles bonded to each other through necks; the resin particles each contain a radiation degradable resin; and an average D1 of the circle-equivalent diameters of the resin particles is 0.1 μm or more and 20 μm or less.

22 Claims, 7 Drawing Sheets

(56) References Cited

U.S. PATENT DOCUMENTS

| | | | |
|---|---|---|---|
| 8,660,472 | B2 | 2/2014 | Kurachi et al. |
| 8,715,830 | B2 | 5/2014 | Yamada et al. |
| 8,771,818 | B2 | 7/2014 | Nishioka et al. |
| 8,852,743 | B2 | 10/2014 | Kikuchi et al. |
| 9,023,465 | B2 | 5/2015 | Yamada et al. |
| 9,086,643 | B2 | 7/2015 | Kikuchi et al. |
| 9,128,403 | B2 | 9/2015 | Yamauchi et al. |
| 9,146,482 | B2 | 9/2015 | Watanabe et al. |
| 9,360,789 | B1 | 6/2016 | Masu et al. |
| 9,442,408 | B2 | 9/2016 | Yamauchi et al. |
| 9,442,451 | B2 | 9/2016 | Yamauchi et al. |
| 9,541,854 | B2 | 1/2017 | Kikuchi et al. |
| 9,547,250 | B2 | 1/2017 | Kikuchi et al. |
| 9,551,949 | B2 | 1/2017 | Yamauchi et al. |
| 9,556,359 | B2 | 1/2017 | Suzumura et al. |
| 9,581,931 | B2 | 2/2017 | Yamada et al. |
| 9,599,913 | B2 | 3/2017 | Nishioka et al. |
| 9,639,009 | B2 | 5/2017 | Yamaguchi et al. |
| 9,651,888 | B2 | 5/2017 | Muranaka et al. |
| 9,665,028 | B2 | 5/2017 | Arimura et al. |
| 9,665,029 | B2 | 5/2017 | Hino et al. |
| 9,740,133 | B2 | 8/2017 | Yamauchi et al. |
| 9,811,009 | B2 | 11/2017 | Yamada et al. |
| 9,811,021 | B2 | 11/2017 | Muranaka et al. |
| 9,958,802 | B2 | 5/2018 | Kikuchi et al. |
| 10,416,588 | B2 | 9/2019 | Masu et al. |
| 2012/0308261 | A1 | 12/2012 | Tsuru et al. |
| 2013/0281276 | A1 | 10/2013 | Watanabe et al. |
| 2014/0072343 | A1 | 3/2014 | Masu et al. |
| 2014/0080691 | A1 | 3/2014 | Kurachi et al. |
| 2015/0198900 | A1 | 7/2015 | Yamada et al. |
| 2015/0331340 | A1 | 11/2015 | Nishioka et al. |
| 2015/0331342 | A1 | 11/2015 | Yamaguchi et al. |
| 2015/0331346 | A1 | 11/2015 | Yamauchi et al. |
| 2015/0331347 | A1 | 11/2015 | Arimura et al. |
| 2016/0154323 | A1 | 6/2016 | Nishioka et al. |
| 2016/0187801 | A1 | 6/2016 | Yamada et al. |
| 2016/0187809 | A1 | 6/2016 | Yamaguchi et al. |
| 2017/0210719 | A1 | 7/2017 | Nishioka et al. |
| 2018/0088476 | A1 | 3/2018 | Takashima et al. |

FOREIGN PATENT DOCUMENTS

| | | | |
|---|---|---|---|
| JP | 2008-276026 | A | 11/2008 |
| JP | 2015-87771 | A | 5/2015 |
| JP | 2016-110125 | A | 6/2016 |

ELECTRO-CONDUCTIVE MEMBER FOR ELECTROPHOTOGRAPHY, PROCESS CARTRIDGE, AND ELECTROPHOTOGRAPHIC IMAGE FORMING APPARATUS

BACKGROUND OF THE INVENTION

Field of the Invention

The present invention relates to an electro-conductive member for electrophotography, a process cartridge, and an electrophotographic image forming apparatus.

Description of the Related Art

In an electrophotographic image forming apparatus (hereinafter sometimes referred to as "electrophotographic apparatus"), there has been used an electro-conductive member for electrophotography, such as a charging member. It is required for the charging member for charging the surface of an electrically chargeable body, such as an electrophotographic photosensitive member to be brought into contact with the electrically chargeable body, to stably charge the electrically chargeable body over a long time period.

In Japanese Patent Application Laid-Open No. 2008-276026, there is a disclosure of a charging member in which a charging defect and a degradation in charging ability caused by dirt on the surface are less liable to occur even in the case of repeated use over a long time period. Specifically, there is a disclosure of a charging member having a protruding portion, which is derived from electro-conductive resin particles, formed on a surface layer of the charging member.

In addition, in Japanese Patent Application Laid-Open No. 2006-91495, there is a disclosure of a charging roll including an electro-conductive covering member having a surface free energy of 30 mN/m or more and a layer of organic fine particles or inorganic fine particles, each having a particle diameter of 3.0 μm or less, formed on an entire surface of the electro-conductive covering member.

SUMMARY OF THE INVENTION

One embodiment of the present invention is directed to providing an electro-conductive member for electrophotography that can maintain a stable charging ability even when an electrophotographic apparatus is used over a long time period.

In addition, other embodiments of the present invention are directed to providing a process cartridge and an electrophotographic apparatus that can stably form high-quality electrophotographic images.

According to one embodiment of the present invention, there is provided an electro-conductive member for electrophotography, including:

an electro-conductive support; and a surface layer formed on the electro-conductive support, in which:

the surface layer has a three-dimensionally continuous skeleton and has pores communicating in a thickness direction thereof, and when an arbitrary 150-micrometer square region of a surface of the surface layer is photographed, and the region is equally divided into 3,600 squares by vertically equally dividing the region into 60 sections and horizontally equally dividing the region into 60 sections, the number of squares each including a through-hole is 100 or less;

the skeleton is non-electro-conductive;

the skeleton includes a plurality of resin particles bonded to each other through necks;

the resin particles each contain a radiation degradable resin; and an average D1 of circle-equivalent diameters of the resin particles is 0.1 μm or more and 20 μm or less.

According to another embodiment of the present invention, there is provided an electro-conductive member for electrophotography, including in this order:

an electro-conductive support;

an intermediate layer; and a surface layer, in which:

the surface layer has a three-dimensionally continuous skeleton and has pores communicating in a thickness direction thereof, and when an arbitrary 150-micrometer square region of a surface of the surface layer is photographed, and the region is equally divided into 3,600 squares by vertically equally dividing the region into 60 sections and horizontally equally dividing the region into 60 sections, the number of squares each including a through-hole is 100 or less;

the skeleton is non-electro-conductive;

the skeleton includes a plurality of resin particles bonded to each other through necks;

an average D1 of circle-equivalent diameters of the resin particles is 0.1 μm or more and 20 μm or less; and the intermediate layer contains a radiation degradable resin and is non-electro-conductive.

According to another embodiment of the present invention, there is provided a process cartridge, which is removably mounted onto a main body of an electrophotographic apparatus, the process cartridge including the electro-conductive member.

According to another embodiment of the present invention, there is provided an electrophotographic apparatus, including the electro-conductive member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The inventors of the present invention have made investigations on the charging members according to Japanese Patent Application Laid-Open No. 2008-276026 and Japanese Patent Application Laid-Open No. 2006-91495, and as a result, have confirmed that the charging members each have a suppressing effect on the adhesion of a toner and an external additive.

However, in recent years, along with an increase in resolution of an electrophotographic image, a charging voltage to be applied between the charging member and an electrically chargeable body tends to increase. That is, when the charging voltage is increased, a developing contrast can be increased. As a result, a gray scale of color can be increased. However, when the charging voltage is increased, abnormal discharge, in which a discharge charge quantity is locally increased, is liable to occur. Under a low-temperature and low-humidity environment, the abnormal discharge is particularly liable to occur.

Discharge from the charging member to a member to be charged occurs in accordance with Paschen's law. In addition, a discharge phenomenon can be explained as the diffusion phenomenon of an electron avalanche in which ionized electrons exponentially increase in number while repeating a process in which the electrons collide with molecules in air or an electrode to produce electrons and positive ions. The electron avalanche diffuses in accordance with an electric field, and the degree of the diffusion determines the final discharge charge quantity.

In addition, the abnormal discharge occurs when a voltage in excess of that derived from Paschen's law is applied, and hence the electron avalanche largely diffuses to provide an extremely large discharge charge quantity. The abnormal discharge may be actually observed with a high speed camera and an image intensifier, and has a size of from about 200 μm to about 700 μm. When its discharge current quantity is measured, the quantity is about 100 or more times as large as the discharge current quantity of normal discharge. Therefore, in order that the abnormal discharge may be suppressed, a discharge charge quantity generated by the diffusion of the electron avalanche under such a condition that an applied voltage is large may only need to be suppressed to a normal range.

Next, electrostatic adhesion of dirt to the surface of the charging member is described. An ion opposite in polarity to the charging voltage adheres to the surface of the charging member and adhering matter on the surface as a result of discharge. Therefore, an electrostatic adhesive force is increased along with the discharge. In particular, under a low-temperature and low-humidity environment, the charge of dirt is not easily canceled by water in air. Therefore, the toner and the external additive are more liable to adhere to the surface of the charging member.

Figure 1:
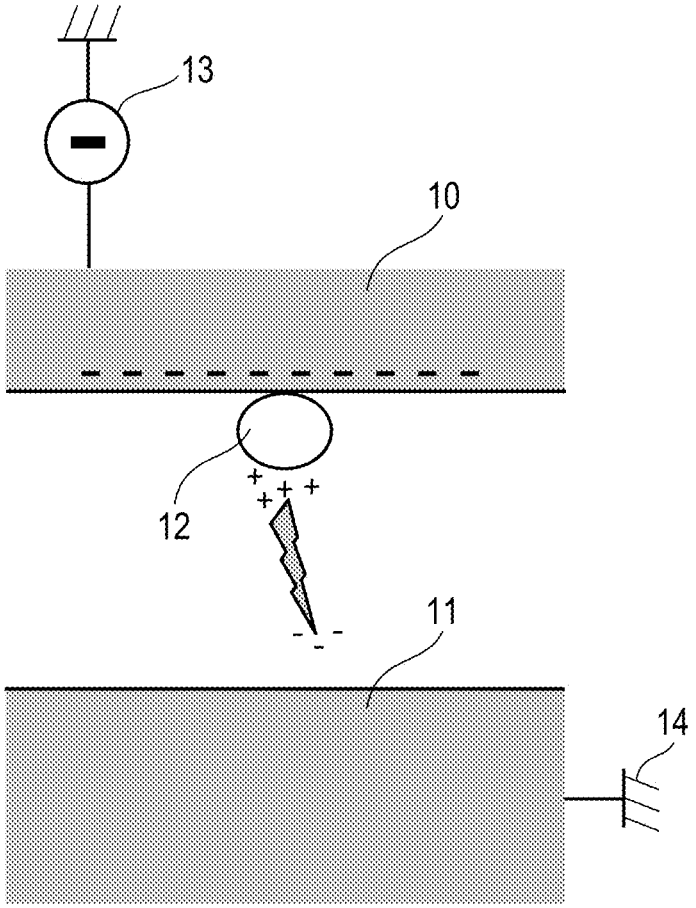
FIG. 1 is an explanatory view of a principle in which dirt electrostatically adheres to the surface of a charging member.

The electrostatic adhesion of the dirt to the surface of the charging member is specifically described below with reference to FIG. 1 by taking a charging apparatus configured to charge the surface of the charging member to negative polarity as an example.

A charging member 10 is connected to a power source 13 and is opposed to a photosensitive drum 11 connected to an earth 14. Discharge occurs in a gap between the charging member 10 and the photosensitive drum 11, and an electron having negative polarity is attracted to the photosensitive drum 11 and an ion having positive polarity is attracted to the surface of the charging member 10, along an electric field. In this case, when dirt 12, such as a toner, exists on the surface of the charging member 10, the ion having positive polarity attracted to the charging member 10 adheres to the dirt 12, and the dirt 12 is positively charged. As a result, electrostatic attraction between the charging member 10 that has been charged to negative polarity and the dirt 12 increases, and the dirt 12 strongly adheres to the surface of the charging member 10. Further, this phenomenon repeatedly occurs along with the progress of use, and hence the adhesive force of the dirt 12 increases.

Then, the inventors of the present invention have made extensive investigations in order to obtain a charging member that is less liable to cause abnormal discharge even when a charging voltage is increased, and that can effectively suppress the electrostatic adhesion of dirt, such as a toner, to the surface of the charging member over a long time period. As a result, the inventors have found that an electro-conductive member according to the following first embodiment and an electro-conductive member according to the following second embodiment satisfy the above-mentioned requirements well.

First Embodiment

An electro-conductive member for electrophotography, including:

an electro-conductive support; and a surface layer formed on the electro-conductive support, in which:

the surface layer has a three-dimensionally continuous skeleton and has pores communicating in a thickness direction thereof, and when an arbitrary 150-micrometer square region of a surface of the surface layer is photographed, and the region is equally divided into 3,600 squares by vertically equally dividing the region into 60 sections and horizontally equally dividing the region into 60 sections, the number of squares each including a through-hole is 100 or less;

the skeleton is non-electro-conductive;

the skeleton includes a plurality of resin particles bonded to each other through necks;

the resin particles each contain a radiation degradable resin; and an average D1 of circle-equivalent diameters of the resin particles is 0.1 μm or more and 20 μm or less.

Second Embodiment

An electro-conductive member for electrophotography, including in this order:

an electro-conductive support;

an intermediate layer; and a surface layer, in which:

the surface layer has a three-dimensionally continuous skeleton and has pores communicating in a thickness direction thereof, and when an arbitrary 150-micrometer square region of a surface of the surface layer is photographed, and the region is equally divided into 3,600 squares by vertically equally dividing the region into 60 sections and horizontally equally dividing the region into 60 sections, the number of squares each including a through-hole is 100 or less;

the skeleton is non-electro-conductive;

the skeleton includes a plurality of resin particles bonded to each other through necks;

an average D1 of circle-equivalent diameters of the resin particles is 0.1 μm or more and 20 μm or less; and the intermediate layer contains a radiation degradable resin and is non-electro-conductive.

(Suppression of Abnormal Discharge)

As described above, the abnormal discharge has a size of from about 200 μm to about 700 μm. This size is the result of the growth of normal discharge along an electric field in a space. That is, in order to suppress the abnormal discharge, it is sufficient that the growth of the normal discharge be suppressed. The normal discharge may be confirmed with a high speed camera and an image intensifier in the same manner as in the abnormal discharge, and its size is 30 μm or less.

The surface layer according to the present invention has a three-dimensionally continuous skeleton, and when an arbitrary 150-micrometer square region of a surface of the surface layer is photographed, and the region is equally divided into 3,600 squares by vertically equally dividing the region into 60 sections and horizontally equally dividing the region into 60 sections, the number of squares each including a through-hole is 100 or less. It is considered that, with this configuration, the diffusion of an electron avalanche is spatially limited, and the normal discharge can be prevented from growing to the size of the abnormal discharge. That is, the surface layer has pores communicating in a thickness direction thereof, but has few through-holes penetrating through the surface layer in the same direction as that of an electric field. Therefore, it is considered that discharge from the surface of the electro-conductive support is disconnected, and an increase in size of the normal discharge is limited.

As a result of direct observation of discharge occurring between the electro-conductive member for electrophotography according to the present invention and a photosensitive drum through use of a highly sensitive camera, the following phenomenon can be confirmed. Single-shot discharge is segmentalized when the surface layer that is a porous body exists on the surface of the electro-conductive member. Also from this phenomenon, it is considered that the above-mentioned presumed mechanism is correct.

(Suppression of Adhesion of Dirt)

Next, the suppression of adhesion of dirt is described. First, dirt adheres to the surface of an electro-conductive member through physical adhesive force or electrostatic attraction. In particular, dirt caused on a charging member has a distribution of from positive charge to negative charge, and hence electrostatic adhesion of dirt cannot be avoided. Further, as described above, in the related-art electro-conductive member, an ion opposite in polarity to an applied voltage adheres to the surface of the charging member and adhering matter on the surface as a result of discharge. Therefore, electrostatic adhesive force is increased along with the discharge, and the peeling of dirt that has once adhered is hardly expected.

The electro-conductive member according to this embodiment can suppress physical adhesion of dirt and electrostatic adhesion of dirt.

First, with regard to the physical adhesion, the surface layer is a porous body having a fine skeleton and pores. Accordingly, a contact point can be made extremely small and hence the physical adhesion of the dirt can be suppressed.

Next, the suppression of the electrostatic adhesion is described with reference to FIG. 2.

Figure 2:
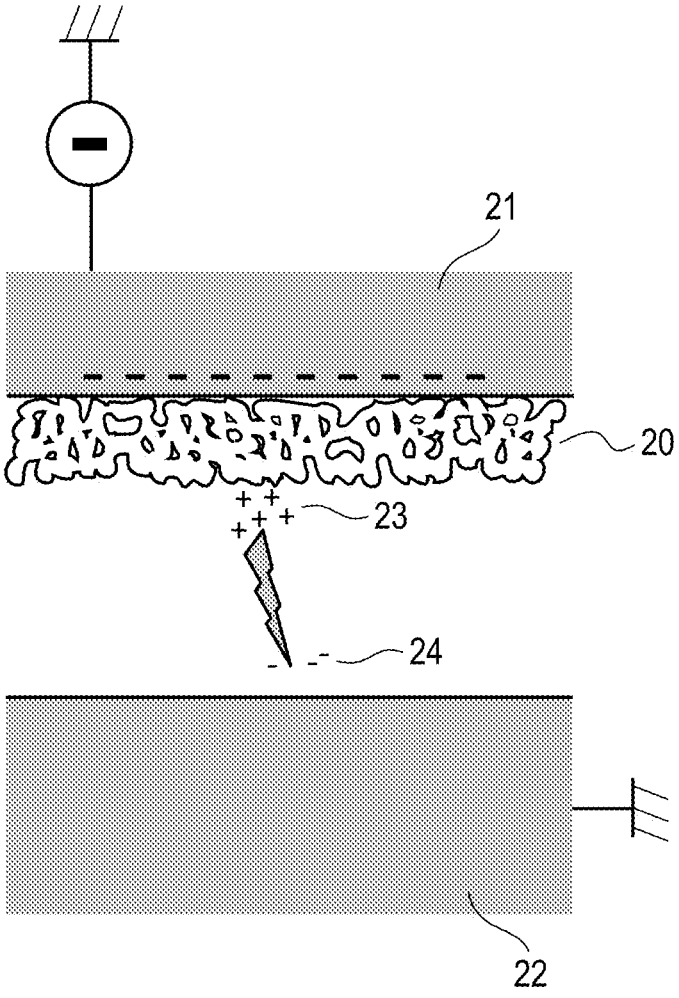
FIG. 2 is an explanatory view of a principle in which charge accumulates on the surface layer of a charging member.

FIG. 2 is a schematic view of a charging member 21 and a photosensitive drum 22 in the case of negative charging. When discharge occurs, a negative charge 24 advances to the surface of the photosensitive drum along an electric field, and a charge 23 having positive polarity advances to a surface layer 20. In this case, the surface layer 20 is non-electro-conductive, and hence the surface layer 20 traps the charge 23 having positive polarity to be positively charged up. In this case, the surface layer 20 electrostatically repels positively-charged dirt that attempts to adhere to the surface of the charging member owing to the electric field, and hence electrostatic attraction acting on the dirt can be reduced. That is, the electrostatic adhesion, which cannot be suppressed in the related art, can be reduced.

Further, even if the dirt adheres to the surface of the surface layer 20, the electrostatically adhering dirt can be expelled because the surface layer 20 is a porous body. Specifically, when the dirt adhering to the surface of the surface layer is irradiated with discharge inside the porous body that has occurred in its pores, the polarity of the dirt can be changed into negative polarity. Accordingly, the direction of the electrostatic attraction acting on the dirt is reversed, and hence the dirt is peeled by the electric field.

That is, both the physical adhesion and electrostatic adhesion of the dirt can be simultaneously suppressed in an extremely efficient manner, and hence it is expected that an image failure derived from the adhesion of the dirt can be reduced.

(Non-Electro-Conductive Intermediate Layer)

In order to suppress the leakage of accumulated charge, the following configuration is also effective: an electro-conductive member, including in this order an electro-conductive support, an intermediate layer, and a surface layer, in which the intermediate layer is non-electro-conductive and contains a radiation degradable resin. With this configuration, even under a state in which a reduction in resistance of the surface layer advances to facilitate the leakage of the accumulated charge, oxidation and the occurrence of a by-product due to discharge in the intermediate layer containing the radiation degradable resin are suppressed, and hence no reduction in resistance of the intermediate layer occurs. The intermediate layer can maintain its non-electro-conductivity, and hence the leakage of the accumulated charge from the surface layer to the electro-conductive support is suppressed. As a result, the accumulated charge of the surface layer can be maintained, and hence a dirt adhesion-suppressing effect can be maintained over a long time period.

For the above-mentioned reasons, according to the present invention, there can be provided a charging member that can achieve both the suppression of the abnormal discharge and the suppression of the image failure caused by the adhesion of dirt. According to the present invention, there can also be provided a process cartridge and an electrophotographic apparatus, each of which can suppress a blank dot image over a long time period, and can suppress an image failure derived from the adhesion of dirt.

First Embodiment

The electro-conductive member according to the first embodiment is described below with reference to the drawings. However, the present invention is not limited to the following embodiment. The electro-conductive member for electrophotography is described below by way of a charging member serving as a representative example thereof. However, the application of the electro-conductive member for electrophotography according to this embodiment is not limited only to the charging member.

(Member Configuration Example)

Figure 3A:
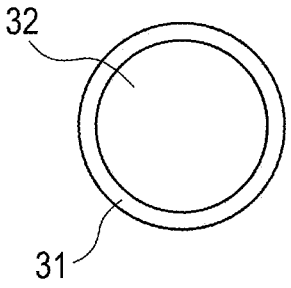
FIG. 3A and FIG. 3B are each a sectional view for illustrating an example of a roller-shaped electro-conductive member.
Figure 3B:
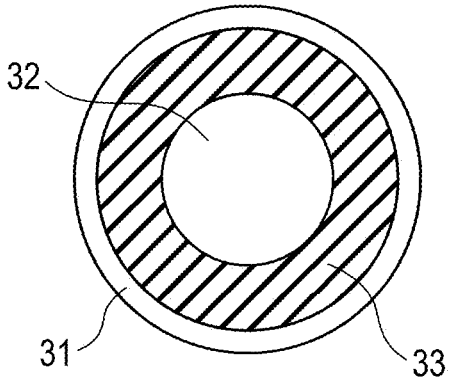

FIG. 3A and FIG. 3B are each a sectional view of an example of a roller-shaped electro-conductive member according to the present invention. The electro-conductive member includes an electro-conductive support and a surface layer formed on an outer side of the electro-conductive support. The surface layer is a porous body. The skeleton of the surface layer includes a plurality of resin particles, and the resin particles each contain a radiation degradable resin.

The electro-conductive member illustrated in FIG. 3A includes the electro-conductive support and a surface layer 31. The electro-conductive support is formed of a cored bar 32 serving as an electro-conductive mandrel (substrate). The surface layer 31 is formed on the outer periphery of the electro-conductive support.

The electro-conductive member illustrated in FIG. 3B also includes the electro-conductive support and the surface layer 31. The electro-conductive support of FIG. 3B is formed of the cored bar 32 serving as an electro-conductive mandrel (substrate) and an electro-conductive resin layer 33 arranged on the outer periphery thereof. The surface layer 31 is formed on the outer periphery of the electro-conductive resin layer 33. The electro-conductive member may have a multilayer configuration in which a plurality of the electro-conductive resin layers 33 are arranged as required to the extent that the effects of the present invention are not impaired. In addition, the electro-conductive member is not limited to one having a roller shape and may have, for example, a blade shape.

Figure 4A:
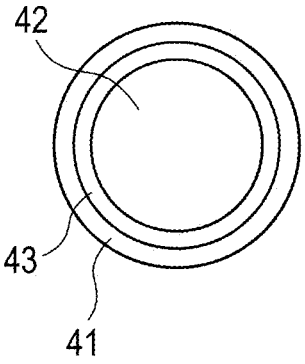
FIG. 4A and FIG. 4B are each a sectional view for illustrating an example of a roller-shaped electro-conductive member including an intermediate layer.
Figure 4B:
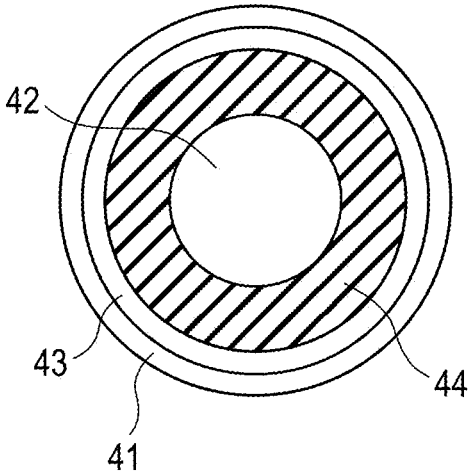

FIG. 4A and FIG. 4B are each a sectional view of an example of a roller-shaped electro-conductive member including an intermediate layer containing a radiation degradable resin according to the present invention. The electro-conductive member includes an electro-conductive support, the intermediate layer, and a surface layer, and the surface layer is a porous body.

The electro-conductive member illustrated in FIG. 4A includes the electro-conductive support, an intermediate layer 43, and a surface layer 41. The electro-conductive support is formed of a cored bar 42 serving as an electro-conductive mandrel. The intermediate layer 43 is formed outside the electro-conductive support, and contains the radiation degradable resin. The surface layer 41 is formed on the outer periphery of the intermediate layer 43.

The electro-conductive member illustrated in FIG. 4B includes the electro-conductive support, the intermediate layer 43, and the surface layer 41. The electro-conductive support includes the cored bar 42 serving as an electro-conductive mandrel and an electro-conductive resin layer 44 arranged on the outer periphery thereof. The intermediate layer 43 contains the radiation degradable resin. The surface layer 41 is formed on the outer periphery of the intermediate layer 43. The electro-conductive member may have a multilayer configuration in which a plurality of the electro-conductive resin layers 44 are arranged as required to the extent that the effects of the present invention are not impaired. In addition, the electro-conductive member is not limited to one having a roller shape and may have, for example, a blade shape.

[Electro-Conductive Mandrel]

An electro-conductive mandrel appropriately selected from ones known in the field of an electro-conductive member for electrophotography may be used as the electro-conductive mandrel. For example, there may be used a cylinder in which the surface of a carbon steel alloy is plated with nickel having a thickness of about 5 μm. The mandrel is preferably made of a metal. When part of energy at the time of discharge is transformed into thermal energy, a mandrel made of a metal having a high thermal conductivity easily causes the thermal energy to escape. Accordingly, damage to the electro-conductive member reduces and hence its durability is improved.

[Electro-Conductive Resin Layer]

A rubber material, a resin material, or the like may be used as a material for forming the electro-conductive resin layer. The rubber material is not particularly limited, and a rubber known in the field of an electro-conductive member for electrophotography may be used. Specific examples thereof include an epichlorohydrin homopolymer, an epichlorohydrin-ethylene oxide copolymer, an epichlorohydrin-ethylene oxide-allyl glycidyl ether terpolymer, an acrylonitrile-butadiene copolymer, a hydrogenated product of an acrylonitrile-butadiene copolymer, a silicone rubber, an acrylic rubber, and a urethane rubber. A resin known in the field of an electro-conductive member for electrophotography may be used as the resin material. Specific examples thereof include a polyurethane resin, a polyamide resin, a polyester resin, a polyolefin resin, an epoxy resin, and a silicone resin.

Of those, an acrylonitrile-based rubber is preferred. This is because in the case of the acrylonitrile-based rubber, even when energy is applied thereto at the time of discharge, the reactivity of the rubber with the surface layer of the present invention is poor, and hence the occurrence of a by-product and discharge deterioration in association therewith hardly occur.

The rubber forming the electro-conductive resin layer may be blended with an electronic conductivity-imparting agent or an ionic conductivity-imparting agent as required in order that the electric resistance value of the layer may be adjusted. Examples of the electronic conductivity-imparting agent include: carbon black, graphite, oxides, such as tin oxide, and metals, such as copper and silver, each showing electronic conductivity; and electro-conductive particles obtained by covering each of the surfaces of particles with any such oxide or metal to impart electro-conductivity to each of the particles. In addition, examples of the ionic conductivity-imparting agent include ionic conductivity-imparting agents each having ion exchange performance, such as a quaternary ammonium salt and a sulfonate each showing ionic conductivity.

In addition, a filler, a softening agent, a processing aid, a tackifier, an antitack agent, a dispersant, a foaming agent, a roughening particle, or the like, which is generally used as a blending agent for a resin, may be added to the extent that the effects of the present invention are not impaired.

As a guideline on the electric resistance value of the electro-conductive resin layer, its volume resistivity is $1\times10^3$ Ω·cm or more and $1\times10^9$ Ω·cm or less. It has been confirmed that the surface layer according to the present invention can suppress an image adverse effect resulting from excessive discharge even when the electric resistance value of the electro-conductive support is sufficiently low.

<Surface Layer>

The surface layer has a three-dimensionally continuous skeleton and has pores communicating in a thickness direction thereof. When an arbitrary 150-micrometer square region of a surface of the surface layer is photographed, and the region is equally divided into 3,600 squares by vertically equally dividing the region into 60 sections and horizontally equally dividing the region into 60 sections, the number of squares each including a through-hole is 100 or less. The skeleton is non-electro-conductive. In addition, the skeleton includes a plurality of resin particles bonded to each other through necks. An average D1 of circle-equivalent diameters of the resin particles is 0.1 μm or more and 20 μm or less.

[(1) Three-Dimensionally Continuous Skeleton and Pores Communicating in Thickness Direction]

The surface layer has a three-dimensionally continuous skeleton. The term "three-dimensionally continuous skeleton" as used herein refers to a skeleton having a plurality of branches and having a plurality of portions connected from the surface of the electro-conductive member to the surface of the electro-conductive support.

In addition, the surface layer has pores communicating in a thickness direction thereof to transport discharge occurring in the skeleton to the surface of the photosensitive drum. The term "pores communicating in a thickness direction" as used herein refers to pores extending from openings of the surface to the surface of the electro-conductive support. In addition, it is preferred that the pores be configured to connect a plurality of openings of the surface of the surface layer and have a plurality of branches. The pores that are configured to connect the plurality of openings and have the plurality of branches as just described can more reliably disperse the electron avalanche in the surface layer.

Further, a discharge path from the surface of the electro-conductive support to the surface of the surface layer is secured by the communicating pores. Accordingly, the electro-conductive member according to this embodiment including the non-electro-conductive surface layer can serve as a charging member to perform discharge needed for the formation of an electrophotographic image.

Here, the discharge conically diffuses along the direction of an electric field. Accordingly, when a thick and linear pore is present in the direction of the electric field, the discharge may grow into abnormal discharge to cause a blank dot image. Therefore, it is preferred that the number of pores to be linearly arranged in the same direction as that of the electric field, i.e., the thickness direction, i.e., through-holes be as small as possible, and the through-holes be fine.

It may be confirmed in an SEM image acquired by a scanning electron microscope (SEM) or a three-dimensional image of a porous body acquired by a three-dimensional transmission electron microscope, an X-ray CT inspection device, or the like that the surface layer has a three-dimensionally continuous skeleton and has pores communicating in a thickness direction thereof. That is, in the SEM image or the three-dimensional image, it is only necessary that the skeleton have a plurality of branches and a plurality of portions connected from the surface of the surface layer to the surface of the electro-conductive support. Further, it is only necessary to confirm that the pores connect a plurality of openings of the surface of the surface layer, and have a plurality of branches and extend from the surface of the surface layer to the surface of the electro-conductive support.

[(2) Uniformity, Through-Holes]

The surface layer needs to have a uniform structure for suppressing an image failure derived from the structure of the porous body. As described above, when a linear through-hole is present in the direction of an electric field, discharge is liable to grow into abnormal discharge. In addition, even a fine through-hole is different in degree of division of an electron avalanche from a site free of any through-hole, and hence the uniformity of the discharge may reduce. Therefore, the number of the through-holes of the surface layer needs to be limited to the following range. The term "through-hole" as used herein refers to a pore linearly leading to the surface of the electro-conductive support through which a person can directly observe the surface of the electro-conductive support when the person is directly opposite to the surface of the surface layer. The through-hole includes a through-hole that branches inside the surface layer, and whether or not a hole at the surface of the surface layer is the through-hole is judged based on whether or not the surface of the electro-conductive support can be directly observed.

Specifically, when an arbitrary 150-micrometer square region of the surface of the surface layer is photographed, and the region is equally divided into 3,600 squares by vertically equally dividing the region into 60 sections and horizontally equally dividing the region into 60 sections, the number of the squares each including a through-hole needs to be set to 100 or less. When the number of the squares each including a through-hole is set to 100 or less, the appearance of the through-hole as a defect of the surface layer in an image can be suppressed.

The number of the squares each including a through-hole is more preferably 25 or less because an effect in which the diffusion of discharge is suppressed and hence abnormal discharge can be suppressed enlarges. A lower limit for the number of the squares each including a through-hole is not particularly limited, and the value is preferably as small as possible.

The through-holes of the surface layer only needs to be confirmed as described below. First, the surface layer is observed from a direction facing the surface layer, and an arbitrary 150-micrometer square region of a surface of the surface layer is photographed. In this case, a method capable of observing the 150-micrometer square region, such as a laser microscope, an optical microscope, or an electron microscope, only needs to be appropriately used.

Next, when the region is equally divided into a group of 3,600 squares by vertically equally dividing the region into 60 sections and horizontally equally dividing the region into 60 sections, the number of squares each including a through-hole only needs to be counted.

[(3) Non-Electro-Conductivity]

The skeleton of the surface layer needs to be non-electro-conductive. The term "non-electro-conductive" means that the volume resistivity of the skeleton is $1\times10^{10}$ Ω·cm or more. When the surface layer is non-electro-conductive, the skeleton of the surface layer traps an ion opposite in polarity to a charging voltage as a result of discharge, and hence can be charged up. When the surface layer charges up, the adhesion of dirt is reduced by electrostatic repulsion. Further, when the adhering dirt is irradiated with discharge in the pores, the charge of the dirt is reversed and hence the dirt can be peeled.

It is preferred that the skeleton of the surface layer have a volume resistivity of $1\times10^{12}$ Ω·cm or more and $1\times10^{17}$ Ω·cm or less. When the volume resistivity is set to $1\times10^{12}$ Ω·cm or more, the skeleton starts being charged up, thereby being capable of suppressing the adhesion of dirt. Meanwhile, when the volume resistivity is set to $1\times10^{17}$ Ω·cm or less, the occurrence of discharge in the pore of the surface layer is accelerated, and dirt can be electrostatically peeled off. Further, it is more preferred that the volume resistivity be set to $1\times10^{15}$ Ω·cm or more and $1\times10^{17}$ Ω·cm or less because the influence of a variation in charge-up in the surface layer can be reduced, and the electrostatic peeling of dirt can be further accelerated.

The volume resistivity of the surface layer is measured by the following measurement method. First, as a test piece, a region free of any pore is removed from the surface layer located on the surface of the electro-conductive member with a pair of tweezers. Then, a cantilever of a scanning probe microscope (SPM) is brought into contact with the test piece, and the test piece is pinched between the cantilever and an electro-conductive substrate to measure a volume resistivity. The electro-conductive member is equally divided into 10 regions in a longitudinal direction thereof. The volume resistivity is measured at any one site in each of the resultant 10 regions (10 sites in total), and the average of the measured values is defined as the volume resistivity of the surface layer.

[(4) Neck]

The skeleton of the surface layer needs to include a plurality of particles bonded to each other through necks. The term "neck" as used herein refers to a portion between particles, which is constricted into a one-sheet hyperbolic shape (drum shape) that is formed by the movement of a constituent material for the particles and that has a smooth curved surface without non-continuous points.

Figure 5A:
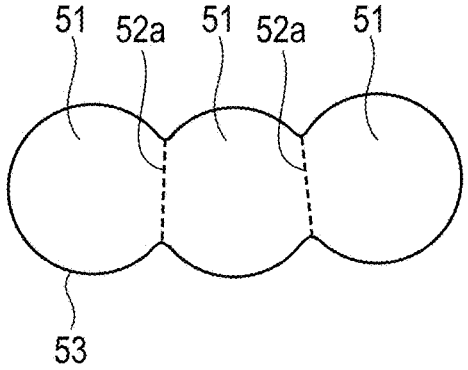
FIG. 5A, FIG. 5B, FIG. 5C, and FIG. 5D are explanatory views of necks.
Figure 5B:
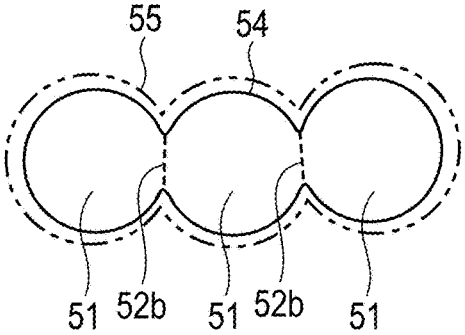
Figure 5C:
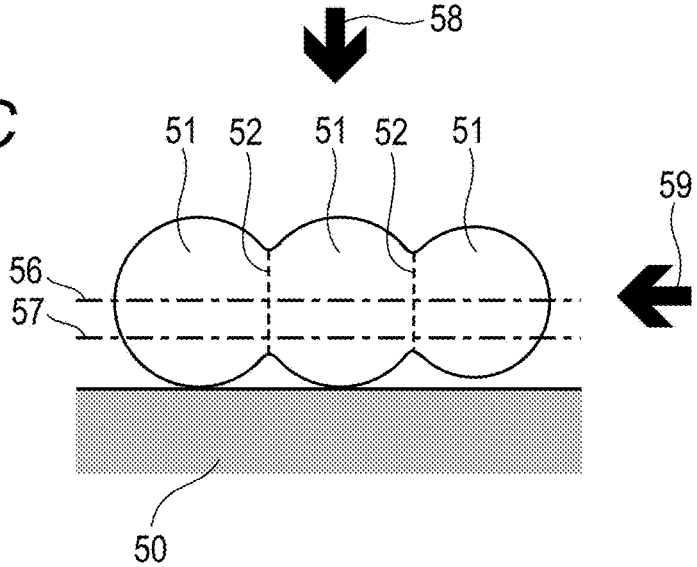

FIG. 5A to FIG. 5D are each a schematic view for two-dimensionally illustrating, as an example of the skeleton of the surface layer, part of a skeleton of a surface layer produced through use of spherical particles. In FIG. 5A to FIG. 5C, particles 51 are bonded to each other through necks 52. The neck 52 is illustrated as a broken line in FIG. 5A to FIG. 5C, but actually refers to a section taken along the broken line of FIG. 5A to FIG. 5C.

Figure 5D:
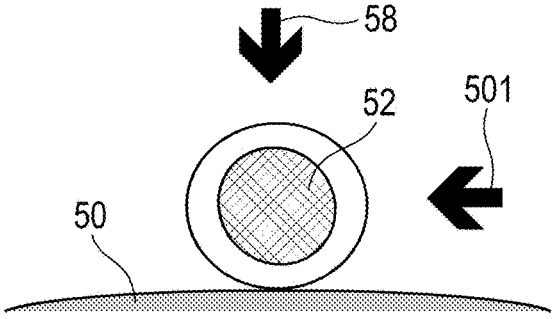

FIG. 5A to FIG. 5C are each an illustration of a cut surface of a plurality of bonded particles, and FIG. 5D is an illustration of a cut surface of a neck portion. For ease of illustration, in FIG. 5A to FIG. 5D, description is given by taking the spherical particles as an example. However, the same description is applicable even to non-spherical particles.

FIG. 5A and FIG. 5B are each an illustration of a cut surface parallel to the surface of the electro-conductive support 50, and FIG. 5C and FIG. 5D are each an illustration of a cut surface perpendicular to the surface of the electro-conductive support 50.

FIG. 5A and FIG. 5B are each a sectional view when seen from the direction of the arrow 58 of FIG. 5C and FIG. 5D. FIG. 5C is a sectional view when seen from the direction of the arrow 501 of FIG. 5D. FIG. 5D is a sectional view when seen from the direction of the arrow 59 of FIG. 5C.

A cut surface 53 indicated by the solid line in FIG. 5A is a cut surface obtained by cutting along a plane 56 illustrated in FIG. 5C. A cut surface 54 indicated by the solid line in FIG. 5B is a cut surface obtained by cutting along a plane 57 illustrated in FIG. 5C, and a double-dotted broken line 55 of FIG. 5B corresponds to the cut surface 53 indicated by the solid line in FIG. 5A. As illustrated in FIG. 5A to FIG. 5C, the area of the cut surface changes and the length of the neck 52 appearing on the cut surface also changes depending on the height of a plane for cutting the skeleton of the surface layer from the surface of the electro-conductive support 50. Specifically, a neck 52*a* illustrated in FIG. 5A is longer than a neck 52*b* illustrated in FIG. 5B.

When the plurality of particles are three-dimensionally linked to each other through the necks, walls forming the pores have irregularities, and hence the shapes of the pores become more complicated. As a result, a suppressing effect on the diffusion of an electron avalanche can be further improved, and hence a suppressing effect on the occurrence of abnormal discharge is further improved.

In addition, when the particles are bonded to each other through the necks, no electrical interface between the particles is present, and hence the skeleton forming the surface layer functions as one dielectric. When the skeleton functions as one dielectric, a partial variation in charge accumulation quantity can be suppressed, and hence uniform discharge can be formed over the entirety of the surface layer.

Further, the irregularities of the wall surfaces of the pores may easily provide an opportunity for discharge. That is, the pores having complicated shapes resulting from the necks can increase the probability that discharge occurs in the pores to increase a charge accumulation quantity. As a result, accelerating effects on the reduction of the adhesion of dirt to the surface of the charging member and the peeling of the dirt can be improved.

In addition, when the resin particles are bonded to each other through the necks to be brought into an integral state free of any interface, a chain reaction based on a radical to be produced in a chemical structure when the particles are subjected to discharge easily occurs. The radical of the radiation degradable resin is unstable, and hence when the chain reaction is facilitated, the probability that the radical causes main chain cleavage can be increased. As a result of the foregoing, a phenomenon in which oxidation or a by-product occurs to reduce the resistance of the surface layer can be suppressed.

For the confirmation of the bonding of the particles through the necks, it is only necessary to observe a bonded portion of the particles based on a three-dimensional image acquired by X-ray CT measurement or with a laser microscope, an optical microscope, an electron microscope, or the like. In this case, it is only necessary to photograph the skeleton and the neck and to confirm that the bonded portion of the particles is constricted into a one-sheet hyperbolic shape (drum shape) having a smooth curved surface without non-continuous points. In addition, as another method of confirming the neck, there may be given a method involving crushing the surface layer with a pair of tweezers to separate the bonded particles from each other. When the separated particles are further observed, traces of the bonding can be confirmed, and hence it can be confirmed that the particles were bonded to each other through the necks.

[Particle Shape]

Particles forming the skeleton of the surface layer may have any shape as long as the three-dimensionally continuous skeleton and the pores communicating in a thickness direction can be formed. The shape may be a spherical shape, an oval shape, a polyhedron shape, such as a cubic shape, a semicircular shape, or any other shape. Of those, particles having complicated shapes formed by pulverization, crushing, or the like are preferred because the particles can increase the surface area of the surface layer to increase the charge-up quantity of the surface layer. Further, the surface shape of the surface layer has irregularities. Accordingly, even when extremely fine irregularities are formed on the surface of the layer by the molecular cleavage of the radiation degradable resin, the amount of change in surface area of the entirety of the layer becomes extremely small, and hence a change in function of the layer due to a change in shape thereof can be suppressed.

For the confirmation of the shape of the particles, it is only necessary to observe a bonded portion of the particles based on a three-dimensional image acquired by X-ray CT measurement or with a laser microscope, an optical microscope, an electron microscope, or the like. In this case, it is only necessary to photograph the skeleton and the neck and to visually confirm the shape of the particles cut by the neck in image processing, to thereby define the result as the shape of the particles.

In addition, as another method of confirming the shape of the particles, there may be given a method involving crushing the surface layer with a pair of tweezers to separate the bonded particles from each other. When the separated particles are further observed, the shape of the particles can be confirmed.

[Average D1 of Circle-Equivalent Diameters of Particles]

It is necessary that the average D1 of circle-equivalent diameters of the particles forming the skeleton of the surface layer be 0.1 μm or more and 20 μm or less. When the average is 0.1 μm or more, the pores are appropriately formed, and discharge in the surface layer can be accelerated to peel dirt. When the average is set to 20 μm or less, an image failure derived from the non-electro-conductive structure can be suppressed. The average is more preferably 0.1 μm or more and 6.0 μm or less. When the average is set to 6.0 μm or less, the amount of the dirt that fits in the pores of the surface of the surface layer is reduced, and hence an image failure derived from the adhesion of the dirt can be suppressed.

For the calculation of the average D1 of the circle-equivalent diameters of the particles, it is only necessary to observe a bonded portion of the particles based on a three-dimensional image acquired by X-ray CT measurement or with a laser microscope, an optical microscope, an electron microscope, or the like. In particular, the X-ray CT measurement is preferred because the surface layer can be three-dimensionally measured. For example, a slice image of a skeleton and a neck is taken through use of an X-ray CT inspection device (product name: TOHKEN-SkyScan2011 (radiation source: TX-300), manufactured by Mars Tohken X-ray Inspection Co., Ltd.) Measurement may be performed based on the acquired slice image by image processing software, such as Image-Pro Plus (product name, manufactured by Media Cybernetics, Inc.).

Specifically, a slice image acquired from two particles bonded to each other through a neck is utilized. A cut surface is found, which is a section perpendicular to the section of the neck as illustrated in FIG. 5A or FIG. 5B, and which is such a cut surface that, out of a plurality of cut surfaces parallel to the surface of the electro-conductive support, the length of the neck included in the cut surface is largest. The found cut surface is binarized by an Ohtsu method. Next, for example, watershed processing is performed to create a neck connecting portions of a contour, which are most recessed. Then, a center of gravity of a particle cut by the neck is calculated, and with the center of gravity being the center, a radius of a circumcircle in contact with a boundary of the particle may be measured as a circle-equivalent diameter of the particle. The electro-conductive member is equally divided into 10 regions in a longitudinal direction thereof. The circle-equivalent diameters of particles are measured in any 50 particles in any image in each of the resultant 10 regions (500 particles in total), and the arithmetic average (hereinafter sometimes referred to as "average") of the measured values is defined as the average D1 of the circle-equivalent diameters of the particles.

In addition, as another method of confirming the shape of the particles, there may be given a method involving crushing the surface layer with a pair of tweezers to separate the bonded particles from each other. An image of the separated particles is acquired on the surface of the electro-conductive support with a laser microscope, an optical microscope, an electron microscope, or the like, and the average D1 of the circle-equivalent diameters may be measured by the same method as above.

[Ratio Between Circle-Equivalent Diameter of Section of Neck and Circle-Equivalent Diameter of Particle]

An average D2 of circle-equivalent diameters of sections of necks for forming the skeleton of the surface layer is preferably 0.1 time or more and 0.7 time or less as large as the average D1 of the circle-equivalent diameters of the particles. When the average is 0.1 time or more, a discharge space can be disconnected to obtain a suppressing effect on abnormal discharge. When the average is set to 0.7 time or less, the electric field in the pore has a complicated distribution, and the probability of the occurrence of discharge in the pore is increased to increase a discharge charge quantity in the pore. As a result, a peeling effect on dirt and an improvement image quality can be obtained.

[Average D2 of Circle-Equivalent Diameters of Sections of Necks]

For the measurement of a circle-equivalent diameter of a section of a neck, it is only necessary to observe a bonded portion of particles based on a three-dimensional image acquired by X-ray CT measurement or with a laser microscope, an optical microscope, an electron microscope, or the like. In particular, the X-ray CT measurement is preferred because the surface layer can be three-dimensionally measured.

Specifically, a slice image acquired from two particles bonded to each other through a neck by the X-ray CT measurement is utilized, and a sectional image of the neck 52 as illustrated in FIG. 5D is created and binarized by an Ohtsu method. Then, a center of gravity of the section of the neck is calculated, and with the center of gravity being the center, a radius of a circumcircle in contact with a boundary of the section of the neck may be measured as a circle-equivalent diameter of the section of the neck. The electro-conductive member is equally divided into 10 regions in a longitudinal direction thereof. The circle-equivalent diameter of the section of the neck is measured in any 20 particles in any image in each of the resultant 10 regions (200 particles in total), and the average D2 of the measured values is calculated.

In addition, as another method of measuring the circle-equivalent diameter of a section of a neck, there may be given a method involving crushing the surface layer with a pair of tweezers to separate the bonded particles from each other. An image of the separated particles is acquired on the surface of the electro-conductive support, and circle-equivalent diameters of the particles and a circle-equivalent diameter of a portion that was a bonded portion corresponding to the section of the neck may be measured.

[Thickness of Surface Layer]

The thickness (film thickness) of the surface layer is preferably 1 μm or more and 30 μm or less. When the thickness of the surface layer is 1 μm or more, the skeleton starts being charged up to express a suppressing effect on abnormal discharge. In addition, when the thickness of the surface layer is 30 μm or less, discharge in the pore reaches the photosensitive drum, and an image can be formed without the occurrence of shortage of charging. The thickness is more preferably 1 μm or more and 20 μm or less. When the thickness is 20 μm or less, the polarity of dirt adhering to the surface layer is suitably inverted, and hence an image failure derived from the adhesion of the dirt can be further suppressed.

In addition, a ratio between the average of the circle-equivalent diameters of the particles and the film thickness is preferably 1.5 or more and 10 or less. The expression "ratio between the average of the circle-equivalent diameters of the particles and the film thickness" as used herein means a value calculated from the expression "{(film thickness)/(average D1 of the circle-equivalent diameters of the particles)}."

When the ratio between the average of the circle-equivalent diameters of the particles and the film thickness is 1.5 or more, the number of the through-holes is small, and hence the reduction of a discharge-disconnecting effect or a dirt adhesion-suppressing effect may seldom occur. In addition, when the ratio between the average of the circle-equivalent diameters of the particles and the film thickness is 10 or less, a discharge charge quantity in the pores may seldom become smaller than a value needed for the peeling of the dirt.

The thickness of the surface layer is confirmed as described below. A segment including the electro-conductive support and the surface layer is cut out of the electro-conductive member, and the segment is subjected to X-ray CT measurement to measure the thickness of the surface layer. Specifically, a two-dimensional slice image acquired by the X-ray CT measurement was binarized by an Ohtsu method to identify a skeleton portion and pore portions. In each of the binarized slice images, the ratio of the skeleton portion was quantified, the numerical value of each region ranging from an electro-conductive support side to a surface layer side was identified, and a region where the ratio of the skeleton portion became 2% or more was defined as the surface layer. Thus, the outermost surface portion and the lowest portion were defined. The term "ratio of the skeleton portion" as used herein means a value calculated from the expression {(area of the skeleton portion)/(area of the skeleton portion+area of the pore portions)}. The electro-conductive member is equally divided into 10 regions in a longitudinal direction thereof. The thickness of the surface layer is measured at any one site in each of the resultant 10 regions (10 sites in total), and the average of the measured values is defined as the thickness of the surface layer.

[Porosity]

The porosity of the surface layer is preferably 20% or more and 80% or less. When the porosity is 20% or more, discharge is allowed to occur in the pores in an amount sufficient for forming an image. In addition, when the porosity is 80% or less, a reducing effect on the diffusion of discharge is expressed, and hence abnormal discharge can be suppressed. The porosity is more preferably 50% or more and 75% or less.

The porosity of the surface layer is confirmed as described below. A segment including the electro-conductive support and the surface layer is cut out of the electro-conductive member, and the segment is subjected to X-ray CT measurement to measure the porosity. Specifically, a two-dimensional slice image acquired by the X-ray CT measurement was binarized by an Ohtsu method to identify a skeleton portion and pore portions. In each of the binarized slice images, the area of the skeleton portion and the area of the pore portions were quantified, the numerical value of each region ranging from an electro-conductive support side to a surface layer side was identified, and a region where the ratio of the skeleton portion became 2% or more was defined as the surface layer. Thus, the outermost surface portion and the lowest portion were defined.

Then, the volumes of the skeleton portion and the pore portions were each calculated, and the volume of the pore portions was divided by their total volume to obtain the porosity. The electro-conductive member is equally divided into 10 regions in a longitudinal direction thereof. The porosity of the surface layer is measured at any one site in each of the resultant 10 regions (10 sites in total), and the average of the measured values is defined as the porosity of the surface layer.

[Properties of Material for Resin Particles]

It is important that the resin particles of the surface layer be non-electro-conductive and be formed of resin particles each containing a radiation degradable resin.

(Long-Term Improvement in Resistance to Dirt Adhesion by Use of Resin Particles Each Containing Radiation Degradable Resin)

In an electrophotographic image forming apparatus, a voltage as high as from several hundreds of volts to several thousands of volts is applied to a charging member. Accordingly, at the time of discharge, even when a charging charge quantity falls within the range of that of normal discharge, large energy is applied to a limited portion of the surface of the charging member. In particular, the surface layer of the electro-conductive member according to this embodiment has a fine porous structure having a large surface area, and hence the amount of energy received per unit area thereof is large.

When such large discharge energy as described above is continuously applied to the resin particles forming the surface layer, part of the bonds, such as a carbon-hydrogen bond, in a polymer skeleton in the chemical structure of a molecule of the resin are cleaved to generate a radical. In ordinary cases, a portion that has become the radical reacts with oxygen or water present in air to take oxygen in the chemical structure. Thus, oxidation advances. Alternatively, the radical forms a new bond with any other radical present around the molecule to produce a by-product. In particular, under high-temperature and high-humidity conditions, the oxidation or the occurrence of the by-product becomes remarkable. This is because at high temperature, the mobility of a molecule of the resin rises to advance its reaction with a surrounding molecule, and at high humidity, the number of water molecules increases to accelerate the oxidation. As a result of the foregoing, there is a risk in that the non-electro-conductivity of the surface layer reduces to leak charge accumulated thereon to the electro-conductive support, and hence a dirt adhesion-suppressing effect exhibited by the charge-up of the layer is inhibited.

The inventors of the present invention have made investigations for achieving the following: even when the surface layer is exposed to discharge energy over a long time period, the conductivity of the surface layer hardly rises and hence the electrostatic adhesion of dirt to the surface layer becomes difficult over a long time period. As a result, the inventors have found that it is effective to use non-electro-conductive resin particles each containing a radiation degradable resin as the resin particles forming the skeleton.

The inventors have considered the reason for the foregoing to be as described below.

The radiation degradable resin has the following tendency: a radical generated by its exposure to discharge is unstable, and hence cannot stably stay at a site where the radical is generated but instead moves to its surrounding environment to allow a chemical structure around itself to cause a chain chemical reaction; and the radical itself of an origin immediately terminates the reaction.

In each of the resin particles, the following molecular cleavage easily occurs: the radical generated in the chemical structure of the resin moves on the skeleton of the main chain thereof to cleave the skeleton of the main chain. The molecular cleavage easily occurs near a terminal of the skeleton, and the occurrence of the cleavage terminates the radical reaction of a main skeleton after the cleavage (skeleton having the longer molecular chain). The decomposition of a skeleton separated from the main skeleton after the cleavage (skeleton that has become extremely short) is advanced by an additional reaction of gasification, and hence the radical disappears. Thus, the entire radical reaction is terminated. Although the main skeleton after the cleavage undergoes a slight reduction in molecular weight, the main skeleton shows no large change as compared to the original polymer skeleton structure except the reduction.

As described above, a process from the generation of the radical to the termination of the reaction quickly advances. Accordingly, oxidation and the occurrence of a by-product hardly advance irrespective of conditions under which the resin particles are used. As a result, the use of the resin particles each containing the radiation degradable resin suppresses the oxidation of the material for the particles and the occurrence of the by-product even under a high-temperature and high-humidity environment, and even when the surface layer is exposed to discharge over a long time period. Therefore, a reduction in resistance of the surface layer is suppressed to reduce the leakage of the charge accumulated thereon, and hence the dirt adhesion-suppressing effect can be maintained over a long time period.

In contrast to the radiation degradable resin, there exists a radiation-crosslinking type resin having the following feature: when irradiated with a radiation, the resin forms a new bond, such as a molecular bridge, to enlarge its molecular structure. The radiation-crosslinking type resin generates a stable radical. Accordingly, the number of opportunities for the radical to react with, for example, oxygen or water around itself increases, and hence oxidation and the formation of a by-product advance. Accordingly, the resistance of the surface layer reduces during discharge and hence the charge accumulated thereon leaks. Therefore, resin particles each containing the radiation-crosslinking type resin are liable to cause the leakage of the accumulated charge. In particular, under high temperature and high humidity, the mobility of a molecule of the resin is liable to rise to advance its reaction with a surrounding molecule.

[Judgment as to Whether or not Resin is Radiation Degradable Resin]

An example of the radiation degradable resin is disclosed on pages 89 to 91 of "Radiation and Polymer" by Kenichi Shinohara et al. (Maki Shoten, published in 1968). In the present invention, a judgment as to whether or not a resin of interest is the radiation degradable resin is performed by measuring a change in molecular weight after a treatment involving applying a radiation or energy equivalent thereto relative to a molecular weight before the treatment. Specifically, corona discharge is performed on the resin and then analysis by gel permeation chromatography (GPC) measurement is performed.

In the GPC measurement, the resin of interest needs to be loaded into a solvent to provide a solution. Here, a solvent in which the resin of interest dissolves most easily, such as toluene, chlorobenzene, tetrahydrofuran (THF), trifluoroacetic acid, 1,1,1,3,3,3-hexafluoro-2-propanol (HFIP), or formic acid, may be selected as the solvent. When the corona discharge advances a crosslinking reaction to extremely increase the molecular weight of the resin, the resin does not dissolve in any solvent and hence molecular weight measurement by the GPC measurement cannot be performed. When the content of an insoluble component is 10 mass % or more with respect to the total amount of the resin like the foregoing, the amount of a crosslinking component except the insoluble component is large, and hence the resin is judged to be a radiation-crosslinking type. Meanwhile, when the content is less than 10 mass %, the GPC measurement of a dissolved resin component is performed by using a solution side. A case in which the molecular weight becomes equal to or less than the molecular weight before the corona discharge treatment means that the cleavage of the molecular skeleton of the resin preferentially occurs, and hence the resin is judged to be radiation degradable. When the molecular weight increases, the resin is a radiation-crosslinking type.

[Glass Transition Temperature Tg of Material for Resin Materials]

The radiation degradable resin preferably has a glass transition temperature Tg of −150° C. or more and 100° C. or less. As long as the glass transition temperature Tg is −150° C. or more, even when energy is applied to the resin particles by discharge, a reduction in porosity due to changes in shapes of the resin particles does not occur, and hence the application does not lead to any charging failure. Meanwhile, as long as the glass transition temperature Tg is 100° C. or less, the treatment temperature at which the necks are formed does not become excessively high.

In a treatment at high temperature, the necks are formed in a sufficiently uniform manner, and hence a black spot due to the nonuniformity of the surface layer does not appear. Further, the glass transition temperature Tg is more preferably −150° C. or more and 0° C. or less in order that the continuity of the surface layer may be improved by activating the molecular motion of the resin to accelerate a binding reaction at the time of the formation of the necks.

In consideration of those characteristics, polyisobutylene that has a glass transition temperature Tg at which the necks can be suitably formed, and that is a radiation degradable resin is preferably used.

[Measurement of Glass Transition Temperature Tg]

The glass transition temperature Tg of each of the resin particles forming the surface layer may be measured by, for example, differential scanning calorimetry (DSC) after the surface layer has been recovered from the electro-conductive member with, for example, a pair of tweezers. In addition, the DSC measurement may be performed after the surface layer has been similarly recovered from the electro-conductive member, and has been melted by heating or with a solvent to be turned into a sheet.

[Additive]

In order to adjust an electric resistivity, an additive may be added to the material for the skeleton of the surface layer to the extent that the effects of the present invention are not impaired and as long as the surface layer can be formed. Examples of the additive include: carbon black, graphite, oxides, such as tin oxide, and metals, such as copper and silver, each showing electronic conductivity; electro-conductive particles obtained by covering each of the surfaces of particles with any such oxide or metal to impart electro-conductivity to each of the particles; and ionic conductivity-imparting agents each having ion exchange performance, such as a quaternary ammonium salt and a sulfonate each showing ionic conductivity. Those additives may be used alone or in combination thereof. In addition, a filler, a softening agent, a processing aid, a tackifier, an antitack agent, a dispersant, or the like, which is generally used as a blending agent for a resin, may be added to the extent that the effects of the present invention are not impaired.

[Radical Scavenger]

A radical scavenger may be added to each of the resin particles. The radical scavenger has a function of scavenging a radical stably present around itself to terminate its reaction. Thus, even when a stable radical is generated in the structure of the radiation degradable resin at the time of the application of discharge energy, a radical reaction can be quickly headed toward its termination. Accordingly, oxidation due to the remaining of the stable radical can be suppressed. Preferred specific examples of the radical scavenger include antioxidants each also having a suppressing effect on the production of a peroxide by air oxidation or the like, such as p-hydroquinone and 3,5-dibutyl-4-hydroxytoluene.

[Molecular Weight of Radiation Degradable Resin]

The weight-average molecular weight (Mw) of the radiation degradable resin is preferably 50,000 or more and 1,500,000 or less. When the weight-average molecular weight is 50,000 or more and 1,500,000 or less, the resin particles each have hardness by virtue of the high molecular weight. Accordingly, even when the electro-conductive member is used for a long time period, the shape of the surface layer does not change and hence stable discharge can be maintained.

The weight-average molecular weight is more preferably 300,000 or more and 1,500,000 or less. In addition, when the weight-average molecular weight becomes 300,000 or more, even in the case where the electro-conductive member is used for a long time period while being in contact with any other member, the breakage of the surface layer can be suppressed.

The weight-average molecular weight of the non-electro-conductive radiation degradable resin forming the surface layer may be measured as described below. A layer of a network structure is recovered from the electro-conductive member with, for example, a pair of tweezers, and its weight-average molecular weight may be measured by, for example, micro-sampling mass spectrometry (μ-MS) or gel permeation chromatography analysis (GPC). In addition, the mass spectrometry may be performed after the surface layer has been similarly recovered from the electro-conductive member, and has been melted by heating or with a solvent to be turned into a sheet.

[Method of Forming Surface Layer and Control of Neck Diameter]

There is no particular limitation on a method of forming the surface layer as long as the surface layer can be formed, and it is only necessary to deposit particles on the electro-conductive support and bond the particles to each other through necks in a later step. As a method of depositing the particles on the electro-conductive support, there are given the following methods: direct coating methods, such as a method involving applying fine particles impregnated into a brush roller or a sponge roller by a roll-to-roll process, an electrostatic powder coating method, a fluidized dip coating method, an electrostatic fluidized dip coating method, and a flame-spray powder coating method; an electrospray method; and a method involving spraying a fine particle dispersion liquid by spray coating. Of those, a method involving applying fine particles impregnated into a brush roller or a sponge roller by a roll-to-roll process is preferred because the thickness of the surface layer can be suitably controlled owing to the simultaneous removal and application of fine particles, and compression can be realized together with application. The application amount can be suitably controlled by the number of rotations and rotation time of the roll.

As a method of bonding the particles to each other through the necks, there are given methods of bonding the particles by heating, thermal crimping, infrared irradiation, and a binder resin. Of those, methods of bonding the particles by subjecting a film of deposited particles obtained through deposition of the particles to heating or thermal crimping are preferred because the particles in the surface layer can also be suitably fused.

The following neck ratio R may be controlled by conditions in the bonding step, for example, a heating temperature and a heating time.

Second Embodiment

The electro-conductive member according to the second embodiment of the present invention is described.

The electro-conductive member according to the second embodiment has the following configuration.

An electro-conductive member for electrophotography, including in this order:

an electro-conductive support;

an intermediate layer; and a surface layer, in which:

the surface layer has a three-dimensionally continuous skeleton and has pores communicating in a thickness direction thereof, and when an arbitrary 150-micrometer square region of a surface of the surface layer is photographed, and the region is equally divided into 3,600 squares by vertically equally dividing the region into 60 sections and horizontally equally dividing the region into 60 sections, the number of squares each including a through-hole is 100 or less;

the skeleton is non-electro-conductive;

the skeleton includes a plurality of resin particles bonded to each other through necks;

an average D1 of circle-equivalent diameters of the resin particles is 0.1 μm or more and 20 μm or less; and the intermediate layer contains a radiation degradable resin and is non-electro-conductive.

[Intermediate Layer Containing Radiation Degradable Resin]

As described in the foregoing, when oxidation occurs or a by-product adheres to the surface layer at the time of the application of discharge energy to the surface layer, accumulated charge leaks from the surface layer to reduce a dirt adhesion-suppressing effect.

As a result of their extensive investigations, the inventors of the present invention have found that even when no radiation degradable resin is incorporated into each of the resin particles forming the surface layer, the arrangement of a non-electro-conductive intermediate layer containing a radiation degradable resin can suppress the leakage of the accumulated charge from the surface layer to the electro-conductive support.

A suppressing effect on the adhesion of dirt to the surface of the electro-conductive member can be maintained over a long time period also by suppressing the leakage of the accumulated charge from the surface layer.

The inventors have considered the reason why the leakage of the accumulated charge can be suppressed to be as describe below.

The surface layer has the communicating pores, and hence discharge occurs from the pores of the outermost surface of the surface layer to the lowest layer on an electro-conductive support side. That is, the entire region in the thickness direction of the surface layer is exposed to the discharge. Therefore, a reduction in resistance of the surface layer due to oxidation or the adhesion of a by-product caused by discharge energy, i.e., the leakage of the accumulated charge may occur over the entire surface of the surface layer. The accumulated charge is leaked to the electro-conductive support by electrostatic attraction because the polarity of the accumulated charge is opposite to the polarity of a voltage to be applied to the electro-conductive support.

Therefore, the leakage of the accumulated charge of the surface layer can be suppressed by arranging the intermediate layer having a blocking effect on the accumulated charge leaking from the surface layer between the surface layer and the electro-conductive support. Further, the surface of the intermediate layer is exposed to the discharge because an influence of the discharge may reach the lowest end on the electro-conductive support side of the surface layer. Therefore, the intermediate layer needs to be formed of a radiation degradable resin that does not cause oxidation or a by-product through the discharge, and to be non-electro-conductive in order that the leakage of the charge may be blocked.

In addition, as described below, the optimization of the volume resistivity of the intermediate layer enables even the intermediate layer to be charged up. Thus, the charge-up quantity of the electro-conductive member can be increased, and hence an abnormal discharge-suppressing effect and the dirt adhesion-suppressing effect are improved.

[Volume Resistivity of Intermediate Layer]

The intermediate layer needs to be non-electro-conductive in order that the leakage of the accumulated charge to the electro-conductive support may be suppressed. The term "non-electro-conductive" means that the volume resistivity of the layer is $1\times10^{10}$ Ω·cm or more.

The volume resistivity of the intermediate layer is preferably $1\times10^{12}$ Ω·cm or more and $1\times10^{17}$ Ω·cm or less. When the volume resistivity is set to $1\times10^{12}$ Ω·cm or more, the leakage of the accumulated charge of the surface layer can be suppressed. Meanwhile, when the volume resistivity is set to $1\times10^{17}$ Ω·cm or less, the charge of discharge in the pores of the surface layer can be sufficiently supplied. When the volume resistivity becomes larger than the value, a discharge charge quantity becomes insufficient and hence a charging failure occurs.

Further, the volume resistivity is more preferably $1\times10^{15}$ Ω·cm or more and $1\times10^{17}$ Ω·cm or less because of the following reason. In this case, the intermediate layer is subjected to discharge and hence can be charged up. The intermediate layer is a continuous layer and, when the layer is charged up, a variation in charge-up quantity thereof can be reduced and hence a dirt adhesion-suppressing effect can be uniformized.

The measurement of the volume resistivity of the intermediate layer is performed as described below. A measured value measured for the electro-conductive member in a state in which the intermediate layer after peeling is present on its outermost surface with an atomic force microscope (AFM) by an electro-conductive mode may be adopted. The intermediate layer is cut out into a sheet with a manipulator, and one surface of the intermediate layer is subjected to metal deposition. A DC power supply is connected to the surface subjected to the metal deposition, and a voltage is applied thereto. The free end of a cantilever is brought into contact with the other surface of the intermediate layer, and a current image is obtained through the main body of the AFM. Current values at 100 randomly selected sites on the surface are measured, and the volume resistivity may be calculated from the average current value of the 10 lowest current values thus measured, the average film thickness of the 10 sites corresponding to the 10 lowest current values, and the contact area of the cantilever.

The volume resistivity of the intermediate layer after an endurance evaluation may be measured in the same manner as that described above after the surface layer has been peeled with a Mending tape, a pair of tweezers, or the like so that the intermediate layer may not be damaged.

[Thickness of Intermediate Layer]

The thickness (film thickness) of the intermediate layer is preferably 1 μm or more and 5 μm or less. When the film thickness is 1 μm or more, the leakage of the accumulated charge of the surface layer to the electro-conductive support can be suppressed, and hence a dirt adhesion-suppressing effect can be maintained. When the maximum value of the film thickness is 5 μm or less, a charging failure resulting from an insufficient discharge charge quantity can be suppressed.

The film thickness of the intermediate layer is measured as described below. Such a sheet that a section of the intermediate layer is exposed is cut out with a sharp cutting tool, such as a razor or a manipulator, and its film thickness is measured in the field of view of an optical microscope or an electron microscope. When the maximum value of the film thickness is represented by A and the minimum value thereof is represented by B, it is preferred that 1 μm≤B and A≤5 μm. The electro-conductive member is equally divided into 10 regions in a longitudinal direction thereof. The thickness of the intermediate layer is measured at any one site in each of the resultant 10 regions (10 sites in total), and the average of the measured values is defined as the thickness of the intermediate layer.

[Material for Intermediate Layer]

As long as the intermediate layer contains the radiation degradable resin and is non-electro-conductive, the layer is not reduced in resistance even when subjected to discharge. Accordingly, the leakage of charge always accumulated between the surface layer and the electro-conductive support can be blocked. Thus, a dirt adhesion-suppressing effect can be maintained over a long time period. With regard to the radiation degradable resin, as in the resin of the surface layer, an example of the radiation degradable resin is introduced in "Radiation and Polymer" by Kenichi Shinohara et al. (Maki Shoten, 1968) as described in the foregoing.

Specific examples thereof include a polyacetal resin, poly(α-styrene), and a cellulose resin. The resin is particularly preferably formed of an acrylic resin having a constituent unit represented by the formula (1).

Formula (1)

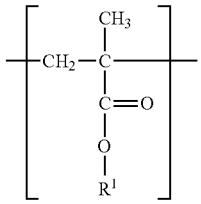

In the formula (1), $R^1$ represents a hydrocarbon group having 1 to 6 carbon atoms. When the $R^1$ represents a hydrocarbon group having 1 to 6 carbon atoms, the amount of a portion that can radicalize at the time of discharge does not become excessively large, and hence oxidation reaction between a radical and oxygen or water around the radical and the formation of a by-product do not become liable to advance.

A copolymer produced from a combination of two or more kinds of monomers serving as raw materials for those polymers may also be used. Examples of the resin materials include the following: polymethyl methacrylate, polyethyl methacrylate, polypropyl methacrylate, polyisopropyl methacrylate, polybutyl methacrylate, poly-t-butyl methacrylate, polyisobutyl methacrylate, and polybenzyl methacrylate. A possible reaction mechanism when the repeating unit is represented by the formula (1) is described by using the reaction formula (1).

In the reaction formula (1), n represents the number of repetitions, and a dot represents a radical. When energy is applied to the resin by discharge, hydrogen on a methyl group bonded to a polymer skeleton serving as a main chain is separated to generate a radical. The generation of the radical easily occurs near a terminal of the skeleton. The generated radical is extremely unstable because of an influence exhibited by the electron-withdrawing action of an ester bond. Accordingly, the next reaction occurs. In other words, the radical attempts to move to any other portion. At that time, the radical moves in a main chain skeleton direction because of an influence of the ester bond. A bond between a quaternary carbon having bonded thereto a methyl group and carbon adjacent thereto in the main chain skeleton direction is cleaved to radicalize the adjacent carbon, and hence molecular cleavage occurs. After the molecular cleavage, a molecule of the resin is divided into a main skeleton and a skeleton whose molecular chain has become extremely short. The reaction is terminated on a main skeleton side, and a radical remains on a shortened skeleton side. The decomposition of the skeleton on the side where the radical remains is advanced by an additional reaction of gasification, and hence the radical disappears. Thus, the entire radical reaction is terminated. In other words, the unstable radical is formed and the termination of the reaction is rapidly performed. Probably because of the foregoing, the number of opportunities for the radical to react with oxygen or water around itself becomes smaller, and hence the oxidation is suppressed.

Reaction formula (1)

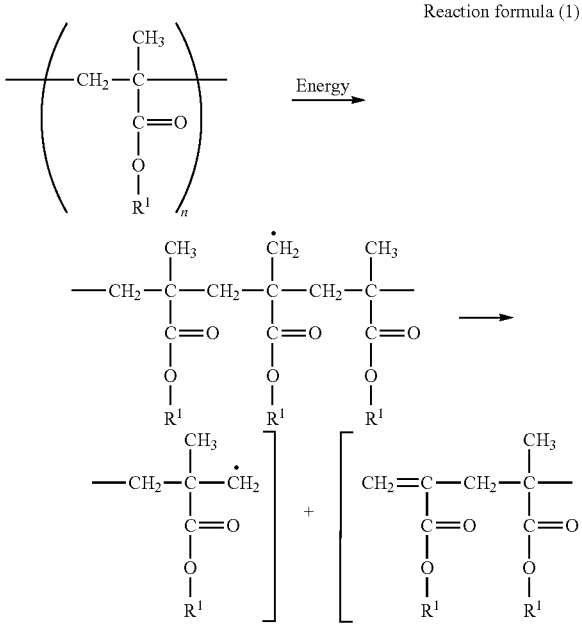

A material in which the $R^1$ in the formula (1) represents a linear or branched alkyl group having 2 or more and 6 or less carbon atoms is more preferred. The $R^1$ does not have any cyclic structure, and hence the formation of a stable radical due to resonance or the like is suppressed. In addition, the number of carbon atoms is plural and hence steric hindrance enlarges. Accordingly, the number of opportunities for a radical to react with a discharge product in the sterically hindered portion reduces, and hence the oxidation is suppressed.

A material in which the $R^1$ represents at least one selected from the group consisting of groups represented by the following formulae (2) to (5) is still more preferred:

$$—C(CH_3)_3, \quad (2)$$

$$—CH(CH_3)_2, \quad (3)$$

$$—CH(CH_3)—C(CH_3)_3, \text{ and} \quad (4)$$

$$—C(CH_3)_2—CH(CH_3)_2. \quad (5)$$

A secondary carbon that is liable to become a radical is absent on the $R^1$, and hence steric hindrance enlarges to suppress the oxidation.

In addition, a material in which the $R^1$ represents (2) $—C(CH_3)_3$ is still further more preferred. This is because of the following reason: the $R^1$ does not have any tertiary carbon, and is formed of a quaternary carbon and a primary carbon, and hence the difficulty with which a stable radical is formed rises to suppress discharge deterioration due to the oxidation. The term "quaternary carbon" means a carbon atom having the following features: the number of adjacent carbon atoms bonded to the carbon atom is 3, and the carbon atom is bonded to an atom except a hydrogen atom (specifically an oxygen atom).

[Method of Producing Intermediate Layer]

A method of producing the intermediate layer is not limited as long as a uniform film can be formed on the electro-conductive support, and the layer may be formed by any such known method as described below: a coating method, such as dipping, a roll coating method, a spraying method, or an electrostatic application method; a tube molding method, such as extrusion or multicolor molding; an inflation molding method; a blow molding method; or lamination. The intermediate layer is preferably formed by the dipping method because a layer having a film thickness of 1 μm or more and 5 μm or less can be formed over the entire surface of the electro-conductive support, and hence charge can be accumulated on the surface layer more reliably.

[Surface Layer of Electro-Conductive Member According to Second Embodiment]

In the electro-conductive member according to the second embodiment, the resin particles forming the skeleton of the surface layer are not required to contain a radiation degradable resin.

However, when the radiation degradable resin is incorporated into each of the resin particles, the surface layer itself can maintain charge accumulated thereon, and the intermediate layer can suppress the leakage of the accumulated charge. Thus, a dirt adhesion-suppressing effect can be further improved.

<Configuration Common to Electro-Conductive Members According to First Embodiment and Second Embodiment>

[Rigid Structure Configured to Protect Surface Layer]

Dirt that attempts to adhere to the surface layer adheres thereto physically or electrostatically. When a rigid structure configured to protect the surface layer is introduced, the surface layer is not brought into contact with the photosensitive drum, and hence a phenomenon in which the dirt physically adheres to the surface layer can be substantially avoided.

In addition, when the surface layer changes in structure, discharging characteristics may also change. Thus, particularly when long-term use is intended, it is preferred that friction and wearing between the surface of the photosensitive drum and the surface layer be reduced to suppress a change in structure of the surface layer by introducing the rigid structure configured to protect the surface layer. In this case, the rigid structure refers to a structure that is deformed in an amount of 1 μm or less when abutting against the photosensitive drum. There is no limitation on a method of providing the rigid structure as long as the effects of the present invention are not impaired. For example, there are given a method involving forming a protruding portion on the surface of the electro-conductive support and a method involving introducing a separating member into the electro-conductive member.

[Protruding Portion on Surface of Electro-Conductive Support]

When the electro-conductive support has the configuration as illustrated in FIG. 4A, there is given a method involving processing the surface of the cored bar 42 into a shape having a protruding portion. An example thereof is a method involving forming the protruding portion on the surface of the cored bar 42 by sandblasting, laser processing, polishing, or the like. The protruding portion may be formed by any other method.

When the electro-conductive support has the configuration as illustrated in FIG. 4B, there is given a method involving processing the surface of the electro-conductive resin layer 44 into a shape having a protruding portion. Examples thereof include a method involving processing the electro-conductive resin layer 44 by sandblasting, laser processing, polishing, or the like, and a method involving dispersing a filler, such as organic particles or inorganic particles, in the electro-conductive resin layer 44.

As a material for forming the organic particles, there are given, for example, a nylon resin, a polyethylene resin, a polypropylene resin, a polyester resin, a polystyrene resin, a polyurethane resin, a styrene-acrylic copolymer, a polymethyl methacrylate resin, an epoxy resin, a phenol resin, a melamine resin, a cellulose resin, a polyolefin resin, and a silicone resin. Those materials may be used alone or in combination thereof.

In addition, as a material for forming the inorganic particles, there are given, for example, silicon oxide, such as silica, aluminum oxide, titanium oxide, zinc oxide, calcium carbonate, magnesium carbonate, aluminum silicate, strontium silicate, barium silicate, calcium tungstate, clay mineral, mica, talc, and kaolin. Those materials may be used alone or in combination thereof. In addition, both of the organic particles and the inorganic particles may be used.

In addition to the above-mentioned method involving processing the electro-conductive support, there is given a method involving introducing a protruding portion independent of the electro-conductive support. An example thereof is a method involving winding a thread-shaped member, such as a wire, around the electro-conductive support.

It is preferred that, in order to obtain a protecting effect on the porous body, the density of the protruding portion be set such that at least part of the rigid structure is necessarily observed in a square region measuring 1.0 mm per side at any position in a surface of the surface layer when observed from a direction facing the surface layer. There is no limitation on the size and thickness of the protruding portion as long as the effects of the present invention are not impaired. Specifically, it is preferred that the size and thickness of the protruding portion each fall within a range in which an image failure is not caused by the presence of the protruding portion. There is no limitation on the height of the protruding portion as long as the height of the protruding portion is larger than the thickness of the surface layer and the effects of the present invention are not impaired. Specifically, it is preferred that the height of the protruding portion fall within a range in which the height of the protruding portion is larger than at least the thickness of the surface layer and a charging failure is not caused by a large discharge gap.

[Separating Member]

There is no limitation on the separating member as long as the separating member can separate the photosensitive drum and the surface layer from each other and the effects of the present invention are not impaired. Examples of the separating member include a ring and a spacer.

As examples of a method of introducing the separating member, there are given the following methods. When the electro-conductive member has a roller shape, there is given a method involving arranging a ring that has an outer diameter larger than that of the electro-conductive member, and that has such hardness as to be capable of retaining a gap between the photosensitive drum and the electro-conductive member so that the rotation centers of the ring and the electro-conductive member may be placed at the same position. When the electro-conductive member has a blade shape, there is given a method involving introducing a spacer capable of separating the electro-conductive member and the photosensitive drum from each other to prevent friction and wearing between the electro-conductive member and the photosensitive drum.

There is no limitation on a material for forming the separating member as long as the effects of the present invention are not impaired. In addition, it is sufficient that a known non-electro-conductive material be appropriately used in order to prevent electric conduction through the separating member. Examples of the material for forming the separating member include: polymer materials excellent in sliding property, such as a polyacetal resin, a high-molecular-weight polyethylene resin, and a nylon resin; and metal oxide materials, such as titanium oxide and aluminum oxide. Those materials may be used alone or in combination thereof.

There is no limitation on a position at which the separating member is introduced as long as the effects of the present invention are not impaired, and for example, it is sufficient that the separating member be set at ends in a longitudinal direction of the electro-conductive support.

Figure 6:
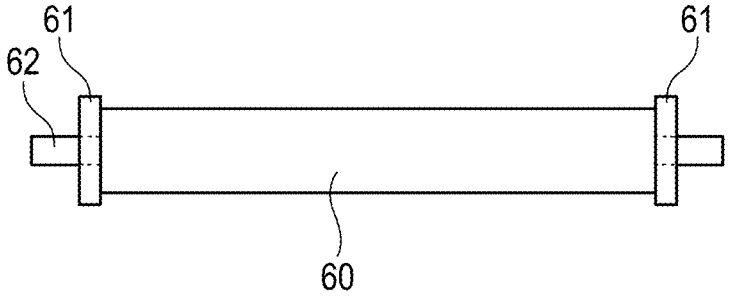
FIG. 6 is a view for illustrating an example of a separating member.

FIG. 6 is an illustration of an example (roller shape) of the electro-conductive member when the separating member is introduced. In FIG. 6, an electro-conductive member is represented by reference numeral 60, a separating member is represented by reference numeral 61, and an electro-conductive mandrel is represented by reference numeral 62.

<Process Cartridge>

Figure 7:
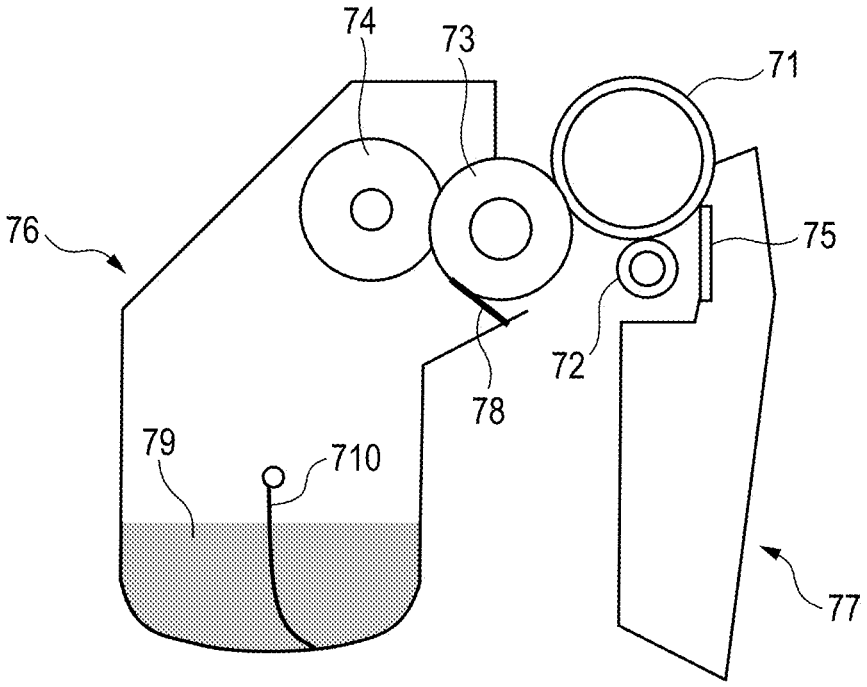
FIG. 7 is a sectional view of a process cartridge according to one embodiment of the present invention.

FIG. 7 is a schematic sectional view of a process cartridge for electrophotography including the electro-conductive member as a charging roller. The process cartridge includes a developing device and a charging device integrally and is removably mounted onto a main body of an electrophotographic apparatus. The developing device includes at least a developing roller 73 and a toner container 76 integrally, and as required, may include a toner supply roller 74, a toner 79, a developing blade 78, and a stirring blade 710. The charging device includes at least a photosensitive drum 71, a cleaning blade 75, and a charging roller 72 integrally, and may include a waste toner container 77. The charging roller 72, the developing roller 73, the toner supply roller 74, and the developing blade 78 are each configured to be supplied with a voltage.

<Electrophotographic Apparatus>

Figure 8:
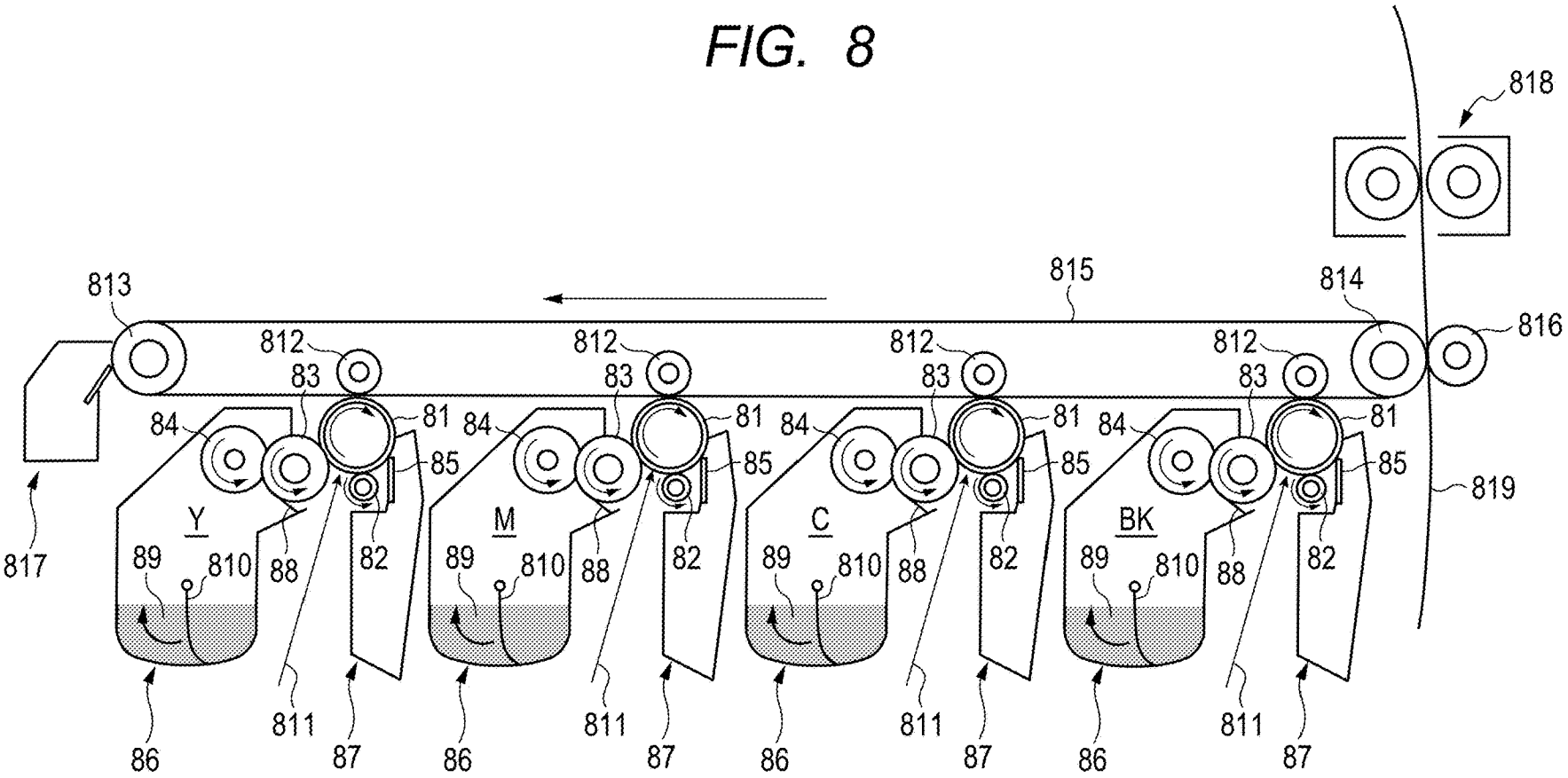
FIG. 8 is a sectional view of an electrophotographic image forming apparatus according to one embodiment of the present invention.

FIG. 8 is a schematic configuration view of an electrophotographic apparatus using the electro-conductive member as a charging roller. The electrophotographic apparatus is a color electrophotographic apparatus having four of the above-mentioned process cartridges removably mounted thereon. The respective process cartridges use toners of respective colors: black, magenta, yellow, and cyan. A photosensitive drum 81 rotates in an arrow direction and is uniformly charged by a charging roller 82 having a voltage from a charging bias power source applied thereto. Then, an electrostatic latent image is formed on a surface of the photosensitive drum 81 with exposure light 811.

Meanwhile, a toner 89 accommodated in a toner container 86 is supplied to a toner supply roller 84 by a stirring blade 810 and conveyed onto a developing roller 83 from the toner supply roller 84. Then, the toner 89 is uniformly applied onto a surface of the developing roller 83 by a developing blade 88 that is held in contact with the developing roller 83, and charge is applied to the toner 89 by friction charging.

The electrostatic latent image is developed with the toner 89 conveyed by the developing roller 83 that is held in contact with the photosensitive drum 81. Thus, the electrostatic latent image is visualized as a toner image.

The visualized toner image on the photosensitive drum is transferred onto an intermediate transfer belt 815, which is supported and driven by an tension roller 813 and an intermediate transfer belt drive roller 814, by a primary transfer roller 812 having a voltage from a primary transfer bias power source applied thereto. Toner images of the respective colors are successively superimposed on each other to form a color image on the intermediate transfer belt.

A transfer material 819 is fed into the apparatus by a sheet feed roller (not shown) and conveyed to between the intermediate transfer belt 815 and a secondary transfer roller 816. A voltage is applied from a secondary transfer bias power source (not shown) to the secondary transfer roller 816 so that the color image on the intermediate transfer belt 815 is transferred onto the transfer material 819. The transfer material 819 having the color image transferred thereon is subjected to a fixing treatment by a fixing unit 818 and delivered out of the apparatus. Thus, a print operation is completed.

Meanwhile, the toner remaining on the photosensitive drum without being transferred is scraped with a cleaning blade 85 to be accommodated in a waste toner accommodating container 87, and the photosensitive drum 81 thus cleaned is repeatedly used in the above-mentioned steps. In addition, the toner remaining on the intermediate transfer belt 815 without being transferred is also scraped with a cleaning device 817.

According to one embodiment of the present invention, there can be provided an electro-conductive member having the following feature: even when an electrophotographic apparatus is used over a long time period, the member can suppress abnormal discharge and dirt adhesion, and hence achieves satisfactory image formation. In addition, according to another embodiment of the present invention, there can be provided a process cartridge and an electrophotographic apparatus, each of which can suppress the occurrence of a blank dot image over a long time period, and can suppress a reduction in charging potential caused by the adhesion of dirt to a charging member to suppress an image failure.

Example 1

[1. Production of Electro-Conductive Support]

A round bar-shaped free-cutting steel having a total length of 252 mm whose outer diameter varied in a stepwise manner was prepared. The central range of the round bar having a length of 230 mm excluding both of its end portions each having a length of 11 mm had an outer diameter of 8.5 mm, and both the end portions each having a length of 11 mm each had an outer diameter of 6 mm. In Example 1, the round bar-shaped free-cutting steel was defined as an electro-conductive support A1.

[2. Preparation of Resin Particles]

Polyisobutylene (weight-average molecular weight: 1,000,000, manufactured by Sigma-Aldrich) was frozen and crushed with a freeze crusher (JFC-2000 (manufactured by Japan Analytical Industry Co., Ltd.)). Next, coarse powder having a particle diameter of 50 μm or more was removed by grinding and classifying the crushed polyisobutylene with a medium-stirring type dry continuous ultrafine pulverizer with a built-in classifier (product name: Fine Mill (Model SF); manufactured by Nippon Coke & Engineering Co., Ltd.). Next, fine powder having a particle diameter of 2 μm or less and coarse powder having a particle diameter of 8 μm or more were classified and removed with an air classifier (product name: ELBOW JET LAB EJ-L3; manufactured by Nittetsu Mining Co., Ltd.). Thus, polyisobutylene particles were obtained.

[3. Formation of Surface Layer]

Figure 9:
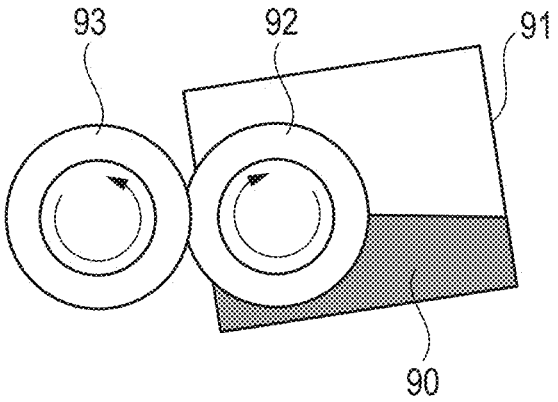
FIG. 9 is a schematic view of an applying apparatus configured to apply particles to form a surface layer.

FIG. 9 is a schematic view of an application device configured to apply particles to form a surface layer. The application device includes particles 90, a particle storage unit 91, a particle application roller 92, and a member 93 to which particles are applied, and an electro-conductive support A1 is installed as the member 93 to which particles are applied. Thus, a surface layer can be formed.

The particle application roller 92 is an elastic sponge roller having a foamed layer formed on an outer periphery of an electro-conductive cored bar. The particle application roller 92 is arranged to form a predetermined contact region (nip part) in a portion opposed to the member 93 to which particles are applied and is configured to rotate in a direction of the arrow (clockwise direction) of FIG. 9. In this case, the particle application roller 92 is held in contact with the member 93 to which particles are applied with a predetermined intrusion amount, that is, a recess caused in the particle application roller 92 by the member 93 to which particles are applied. When the particles are applied, the particle application roller 92 and the member 93 to which particles are applied rotate to move in opposite directions in the contact region. With this operation, the particle application roller 92 applies the particles to the member 93 to which particles are applied, and the particles on the member 93 to which particles are applied are removed.

As the particles 90 for forming the surface layer, the polyisobutylene particles produced by the freezing and the crushing were applied to the electro-conductive support A1 by driving and rotating the particle application roller 92 at 90 rpm and the electro-conductive support A1 at 100 rpm for 10 seconds. Thus, an unheated electro-conductive member a1.

Then, the unheated electro-conductive member a1 was loaded into an oven and heated at a temperature of 80° C. for 2 hours. Thus, an electro-conductive member (charging roller) A1 for electrophotography was obtained.

(4. Evaluation of Characteristics)

The electro-conductive member A1 according to this example was subjected to the following evaluation test. The evaluation results are shown in Table 7-1 and Table 7-1. When the electro-conductive member is a roller-shaped electro-conductive member, an x-axis direction, a y-axis direction, and a z-axis direction respectively refer to the following directions.

The x-axis direction refers to a longitudinal direction of a roller (electro-conductive member).

The y-axis direction refers to a tangential direction in a transverse section (that is, a circular section) of the roller (electro-conductive member) orthogonal to an x-axis.

The z-axis direction refers to a diameter direction in the transverse section of the roller (electro-conductive member) orthogonal to the x-axis. In addition, the term "xy-plane" refers to a plane orthogonal to the z-axis, and the term "yz-section" refers to a section orthogonal to the x-axis.

[Evaluation 4-1. Confirmation of Three-Dimensionally Continuous Skeleton and Pores Communicating in Thickness Direction, and Confirmation of Presence or Absence of Necks Between Plurality of Resin Particles Forming Skeleton]

Whether or not the surface layer had a co-continuous structure was confirmed by the following method. A segment of the surface layer having a length of 250 μm each in an x-axis direction and in a y-axis direction and having a depth of 700 μm including the electro-conductive support A1 in a z-axis direction was cut out of the electro-conductive member A1 by a focused ion beam method. Then, the segment was subjected to three-dimensional reconstruction with an X-ray CT inspection device (product name: TOHKEN-SkyScan 2011 (radiation source: TX-300), manufactured by Mars Tohken X-ray Inspection Co., Ltd.). Two-dimensional slice images (parallel to an xy-plane) were cut out of the three-dimensional image thus obtained at an interval of 1 μm with respect to a z-axis. Then, the slice images were binarized so that a skeleton portion and pore portions were identified. The slice images were checked successively with respect to the z-axis to confirm whether or not the skeleton portion was three-dimensionally continuous and the pore portions communicated in a thickness direction. In a table showing a result of this evaluation, a case in which the skeleton portion was three-dimensionally continuous and the pore portions communicated in the thickness direction was represented as "Y", and a case in which the skeleton portion was three-dimensionally continuous and the pore portions did not communicate in the thickness direction was represented as "N".

In addition, whether or not the skeleton portion included a plurality of resin particles bonded to each other through necks was confirmed. In a table showing a result of this evaluation, a case in which the skeleton portion included the plurality of resin particles bonded to each other through the necks was represented as "Y", and a case in which the skeleton portion did not include the plurality of resin particles bonded to each other through the necks was represented as "N".

[Evaluation 4-2. Evaluation of Through-Holes]

Platinum was deposited from the vapor on the surface of the segment to obtain a deposited segment. Then, the surface of the deposited segment was photographed from the z-axis direction at a magnification of 1,000 with a scanning electron microscope (SEM) (product name: S-4800, manufactured by Hitachi High-Technologies Corporation) to obtain a surface image.

Next, in the surface image, 59 dividing lines were created vertically and 59 dividing lines were created horizontally at an interval of 2.5 μm in a 150-micrometer square region to form a group of 3,600 squares in total to acquire an evaluation image by image processing software "Image-Pro Plus" (product name, manufactured by Media Cybernetics, Inc.).

Then, in the evaluation image, the number of squares including the surface of the electro-conductive support in the 3,600 grids (squares) was visually counted. The evaluation was carried out based on the following criteria. The evaluation results are shown in Table 7-2. The term "squares including the surface of the electro-conductive support" as used herein refers to "squares in which the surface of the electro-conductive support can be visually confirmed from the surface of the surface layer."

<<Evaluation Criteria>>

Rank A: The total number of the squares including the surface of the electro-conductive support is 5 or less.

Rank B: The total number of the squares including the surface of the electro-conductive support is 6 or more and 25 or less.

Rank C: The total number of the squares including the surface of the electro-conductive support is 26 or more and 100 or less.

Rank D: The total number of the squares including the surface of the electro-conductive support is 101 or more.

[Evaluation 4-3. Evaluation of Non-Electro-Conductivity of Surface Layer]

The volume resistivity of the surface layer was measured in a contact mode through use of a scanning probe microscope (SPM) (product name: Q-Scope 250, manufactured by Quesant Instrument Corporation).

First, The electro-conductive member A1 (length in a longitudinal direction: 230 mm) was equally divided into 10 regions in a longitudinal direction thereof. From each of the regions, a skeleton forming the surface layer was collected with a pair of tweezers, and 10 of test pieces were prepared. Then, each of the test pieces was placed on a metal plate made of stainless steel to obtain 10 of measurement segments. Next, regarding each of the measurement segments, following measurements were conducted. That is, a cantilever of the SPM was brought into contact with the test piece on the metal plate, and a voltage of 50 V was applied to the cantilever so that a current value was measured.

From the observation of the specimen with the SPM, a thickness of a measurement site of the test piece, where the current value was measured, and a contact area of which the cantilever was in contact with the test piece were calculated.

Then, volume resistivity of each of the surface layer was calculated from the thickness and the contact area. The average of the measured values was defined as the volume resistivity of the surface layer. The evaluation results are shown in Table 7-2.

The measurement was performed before an endurance evaluation and after the endurance evaluation, and the reduction ratio of the volume resistivity was calculated from the quotient of the two values.

[Evaluation 4-4. Evaluation of Quantity of Accumulated Charge of Surface Layer]

The surface potential of an electro-conductive member (charging member) caused by corona discharge was measured through use of a charge quantity measurement device (product name: DRA-2000L, manufactured by Quality Engineering Associates (QEA) Inc.). Specifically, a corona discharger of the charge quantity measurement device was arranged so that a gap between a grid portion thereof and the surface of the electro-conductive member A1 became 1 mm. Then, a voltage of 8 kV was applied to the corona discharger to cause discharge, to thereby charge the surface of the electro-conductive member. After the completion of the discharge, the surface potential of the electro-conductive member after an elapse of 10 seconds was measured. In order to confirm a suppressing effect on dirt adhesion due to long-term use, the measurement was performed before an endurance evaluation and after the endurance evaluation.

[Evaluation 4-5. Evaluation of Average D1 of Circle-Equivalent Diameters of Particles]

The surface layer formed on the surface of the segment was crushed with a pair of tweezers while the surface layer was observed with a stereoscopic microscope at a magnification of 1,000, and the particles were decomposed into each particle so that the particles were not deformed on the surface of the electro-conductive support. Next, platinum was deposited from the vapor onto the resultant to obtain a deposited segment. Then, the surface of the deposited segment was photographed at a magnification of 1,000 through use of a scanning electron microscope (SEM) (product name: S-4800, manufactured by Hitachi High-Technologies Corporation) from the z-axis direction to acquire a surface image.

Then, the surface image was processed with image processing software "Image-Pro Plus" (product name, manufactured by Media Cybernetics, Inc.) so that the particles became white and the surface of the electro-conductive support became black, and circle-equivalent diameters of any 50 particles were measured with a counting function. The electro-conductive member A1 was equally divided into 10 regions in a longitudinal direction thereof, and the above-mentioned measurement was performed in the resultant 10 regions to measure circle-equivalent diameters of any 500 particles in total. The arithmetic average of the 500 circle-equivalent diameters was defined as the average D1 of the circle-equivalent diameters of the particles.

[Evaluation 4-6. Evaluation of Average D2 of Circle-Equivalent Diameters of Sections of Necks]

The circle-equivalent diameters of the necks of 20 particles out of the 50 particles for which the average D1 of the circle-equivalent diameters of the particles had been measured were measured with the distance-measuring function of image processing software "Image-Pro Plus" (product name, manufactured by Media Cybernetics, Inc.). Next, a ratio between the average D1 of the circle-equivalent diameters of the particles and the average D2 of the circle-equivalent diameters of the necks was calculated for the 20 particles.

The above-mentioned operation was performed at any one point in each of 10 regions obtained by equally dividing the electro-conductive member A1 into the 10 regions in a longitudinal direction thereof (200 points in total). The arithmetic average of the ratios between the averages D1 of the circle-equivalent diameters of the 200 particles and the averages D2 of the circle-equivalent diameters of the necks was defined as a neck ratio R.

[Evaluation 4-7. Evaluation of Thickness of Surface Layer]

The two-dimensional slice images obtained in the X-ray CT measurement were binarized, and the skeleton portion and the pore portions were distinguished from each other. In each of the binarized slice images, the ratio of the skeleton portion was quantified, the numerical value of each region ranging from an electro-conductive support side to a surface layer side was identified, and a region where the ratio of the skeleton portion became 2% or more was defined as the outermost surface portion of the surface layer. The thickness (thickness from the surface of the electro-conductive support to the outermost surface portion of the surface layer) of the surface layer was measured by the foregoing method.

The above-mentioned operation was performed at any one point in each of 10 regions obtained by equally dividing the electro-conductive member A1 into the 10 regions in a longitudinal direction thereof (10 points in total), and the average thickness thereof was defined as the thickness of the surface layer.

[Evaluation 4-8. Evaluation of Porosity of Surface Layer]

The ratio of the pore portions in a three-dimensional image obtained by the above-mentioned X-ray CT evaluation was quantified to determine the porosity of the surface layer. The above-mentioned operation was performed at any one point in each of 10 regions obtained equally dividing the electro-conductive member A1 into the 10 regions in a longitudinal direction thereof (10 points in total), and the average thereof was defined as the porosity of the surface layer.

[Evaluation 4-9. Measurement of Glass Transition Temperature Tg]

First, the surface layer of the electro-conductive member A1 was peeled with a pair of tweezers. Thus, a sample was obtained in an amount of 3 mg. The sample was subjected to differential scanning calorimetry with a differential scanning calorimeter (manufactured by Yamato Scientific Co., Ltd., DSC7020 AS). The sample was left at rest at a temperature of −150° C. for 30 minutes, and then the balance of thermal energy was measured while its temperature was changed to 250° C. at a rate of temperature increase of 10° C./min. A glass transition temperature Tg was obtained from the measured data with analysis software attached to the apparatus.

[Evaluation 4-10. Confirmation of Radiation Degradation Properties of Non-Electro-Conductive Resin Particles]

This evaluation is intended to judge whether or not the resin particles forming the surface layer according to the present invention are each formed of a radiation degradable resin. Whether or not the particles are each formed of the radiation degradable resin is confirmed as described below. First, resin particles forming a surface layer are sampled from an electro-conductive member for electrophotography immediately after its production that has not been exposed to corona discharge yet, and the molecular weight of a resin forming each of the resin particles is measured by gel permeation chromatography (GPC). Next, the electro-conductive member for electrophotography is subjected to a corona discharge treatment by a predetermined method. After that, the resin particles forming the surface layer of the electro-conductive member for electrophotography are sampled, and the molecular weight of the resin of each of the particles is measured by GPC. Then, whether or not the resin in each of the resin particles is radiation degradable is judged based on a difference between the molecular weights before and after the corona discharge. The foregoing method is described in detail below.

First, 5 mg of a sample is collected from the surface layer of the electro-conductive member A1 immediately after its production that has never been subjected to corona discharge. A sample solution having a concentration of 1 mass % is prepared by selecting, from toluene, chlorobenzene, tetrahydrofuran (THF), trifluoroacetic acid, and 1,1,1,3,3,3-hexafluoro-2-propanol (HFIP), a solvent that easily dissolves the sample. Chlorobenzene was used as a solvent for the sample collected from the surface layer of the electro-conductive member A1.

A molecular weight was measured with the prepared sample solution under the following conditions. A column is stabilized in a heat chamber at a temperature of 40° C., and the solvent used in the dissolution of the sample is flowed as an eluent in the column at the temperature at a flow rate of 1 mL/min. One hundred microliters of the sample solution is injected into the column. At the time of the measurement of the molecular weight of the sample, the molecular weight distribution of the sample is calculated from a relationship between the logarithmic value and retention time of a calibration curve created with several kinds of monodisperse polystyrene standard samples (product name: TSKgel Standard Polystyrene "0005202" to "0005211", manufactured by Tosoh Corporation).

In addition, a gel permeation chromatograph (GPC) apparatus (product name: HLC-8120, manufactured by Tosoh Corporation) is used as a GPC apparatus, and a refractive index detector (product name: RI-8020, manufactured by Tosoh Corporation) is used as a detector. A combination of three commercial polystyrene gel columns (product name: TSK-GEL SUPER HM-M, manufactured by Tosoh Corporation) is used as the column.

The Mw of the sample sampled from the surface layer according to the electro-conductive member A1 before the corona discharge treatment was 1,000,000.

Subsequently, the corona discharge treatment of the electro-conductive member A1 was performed with a corona discharge surface treatment apparatus manufactured by Kasuga Electric Works Ltd. The environment under which the treatment was performed was an H/H environment (environment at a temperature of 30° C. and a relative humidity of 80%).

Figure 10:
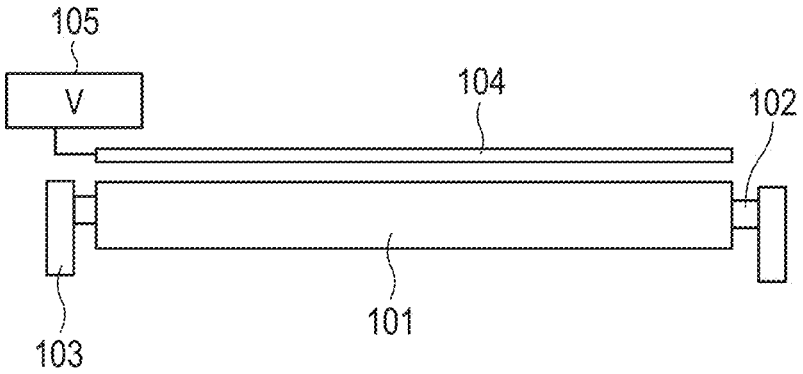
FIG. 10 is a schematic view of a corona charger.

A detailed method for the corona discharge is described with reference to FIG. 10.

Both end portions 102 of an electro-conductive member 101 were fixed with supporting portions 103, and positioning was performed so that the longitudinal direction of a corona electrode 104 made of aluminum became parallel to the longitudinal direction of the electro-conductive member 101, and the surface of the corona electrode 104 faced the surface of the electro-conductive member 101. A distance between the surface of the corona electrode 104 and the surface of the electro-conductive member 101 in a portion where the surfaces were closest to each other was set to 1 mm. The electro-conductive member 101 was rotated by rotating each of the supporting portions 103 at a speed of 30 revolutions/min, and a state in which a voltage of 8 kV was applied from a power supply 105 toward the electrode was continued for 2 hours.

After that, 5 mg of a sample is sampled from the surface layer of the electro-conductive member 101, and its weight-average molecular weight (Mw) is measured by GPC by the same method as that described above. Then, when the Mw of the sample sampled from the electro-conductive member after the corona discharge became smaller than the Mw of the sample sampled from the electro-conductive member before the corona discharge, a resin forming the surface layer was judged to be a radiation degradable resin.

In addition, when the Mw increased after the corona discharge, the resin was judged to be a radiation-crosslinking type resin. A case in which resin particles forming a surface layer and/or an intermediate layer according to each of Examples and Comparative Examples were each formed of the "radiation degradable resin" was represented as "Y", and a case in which the resin particles were each formed of the "radiation-crosslinking type resin" was represented as "N".

(5. Evaluation of Image)

The electro-conductive member A1 was subjected to the following evaluation test.

[Evaluation 5-1. Evaluation of Image Quality Black Spot]

A suppressing effect on an image failure (black spot) derived from the non-electro-conductive skeleton in an initial stage (before an endurance test (repeated use test)) of the electro-conductive member A1 was confirmed by the following method. An electrophotographic laser printer (product name: Laserjet CP4525dn, manufactured by Hewlett-Packard Development Company, L.P.) was prepared as an electrophotographic apparatus. In order to put the electro-conductive member in a more severe evaluation environment, the laser printer was remodeled so that the number of sheets to be output per unit time was 50 sheets/min, in terms of A4-size sheets, which was larger than the original number of sheets to be output. In this case, the output speed of a recording medium was set to 300 mm/sec, and the image resolution was set to 1,200 dpi.

Next, the electro-conductive member A1 was mounted as a charging roller on a toner cartridge dedicated to the laser printer. The toner cartridge was loaded on the laser printer, and a half-tone image (image in which lateral lines were drawn at a width of one dot and an interval of 2 dots in a direction perpendicular to the rotation direction of the photosensitive drum) was output in an H/H environment (environment at a temperature of 30° C. and a relative humidity of 80%). In this case, the voltage applied between the charging roller and the electrophotographic photosensitive member was set to −1,200 V. The presence or absence of an image failure resulting from the charging member was confirmed by visually observing the resultant image. When the image failure was observed, its degree was evaluated based on the following criteria.

<<Evaluation Criteria>>

Rank A: No black spot image is observed.

Rank B: A slight black spot is partially observed.

Rank C: A slight black spot is observed over an entire surface.

Rank D: A black line in the shape of a streak is observed and conspicuous.

[Evaluation 5-2. Evaluation of Blank Dot Image Voltage at which Blank Dot Image Occurs]

The image acquired in the section [Evaluation 5-1. Evaluation of Image Quality] was visually observed, and the presence or absence of image unevenness (blank dot image) resulting from local strong discharge from the charging member was observed.

Next, the output and visual evaluation of electrophotographic images were repeated in the same manner as described above, except for changing the applied voltage in decrements of 10 V from −1,010 V, −1,020 V, −1,030 V, . . . . Then, the applied voltage was measured at a time when an electrophotographic image, in which image unevenness (blank dot image) resulting from local strong discharge from the charging member was able to be visually confirmed, was formed. The applied voltage in this case was shown in a table as a voltage at which a blank dot image occurred before an endurance test.

[Evaluation 5-3. Evaluation of Image Failure Derived from Dirt Adhesion after Endurance Test White Spot]

Next, an endurance test was performed to evaluate an image failure derived from dirt adhesion.

The endurance test was performed with the process cartridge and the electrophotographic apparatus described in the section "Evaluation 5-1. Evaluation of Image Quality" under the H/H environment.

In the endurance test, an electrophotographic image is output on 80,000 sheets by repeating the following intermittent image forming operation: after the image has been output on 2 sheets, the rotation of a photosensitive drum is completely stopped for about 3 seconds, and image output is restarted. The image to be output at this time was such an image that an alphabet letter "E" having a size of 4 points was printed so as to have a coverage of 4% with respect to the area of A4 size paper.

After the endurance, a halftone (such an image that horizontal lines each having a width of 1 dot were drawn in a direction vertical to the rotation direction of the photosensitive drum at an interval of 2 dots) image was output. The halftone image was evaluated for an image failure derived from dirt adhesion based on the following criteria.

<<Evaluation Criteria>>

Rank A: No image defect derived from dirt adhesion is observed.

Rank B: A slight image defect (white spot) derived from dirt adhesion is partially observed.

Rank C: A slight image defect (white spot) derived from dirt adhesion is observed over an entire surface.

Rank D: An image defect (white spot) derived from dirt adhesion is observed over the entire surface, and is observed as a vertical streak.

Examples 2 to 11

[1. Production of Electro-Conductive Support]

Electro-conductive supports were produced in the same manner as in the electro-conductive support A1 according to Example 1.

[2. Preparation of Resin Particles]

Resin particles to be used in the formation of electro-conductive members according to Examples 2 and 3 were produced in the same manner as in the polyisobutylene particles according to Example 1 except that particles each having a particle diameter of 3 μm or more were classified and removed with an air classifier after the removal of the coarse powder having a particle diameter of 50 μm or more.

In addition, resin particles to be used in the formation of electro-conductive members according to Examples 7 and 8 were produced in the same manner as in the polyisobutylene particles according to Example 1 except that particles each having a particle diameter of 15 μm or less were classified and removed with an air classifier after the removal of the coarse powder having a particle diameter of 50 μm or more.

Resin particles to be used in the formation of electro-conductive members according to Examples 4 to 6 and 9 to 11 were produced in the same manner as in the polyisobutylene particles according to Example 1.

[3. Formation of Surface Layer]

Electro-conductive members A2 to A11 were produced in the same manner as in Example 1 except that: the resin particles prepared in the section 2 were used; and the rotation time (application time) of the electro-conductive support was changed as shown in Table 1.

TABLE 1

| Example | Rotation time of electro-conductive support (sec) |
|---|---|
| 2 | 2 |
| 3 | 1 |
| 4 | 15 |
| 5 | 30 |
| 6 | 40 |
| 7 | 30 |
| 8 | 40 |
| 9 | 3 |
| 10 | 21 |
| 11 | 2 |

Examples 12 to 19

[1. Production of Electro-Conductive Support]

Electro-conductive supports were produced in the same manner as in the electro-conductive support A1 according to Example 1.

[2. Preparation of Resin Particles]

The material for the resin particles was changed to a material shown in Table 2. In addition, with regard to resin particles to be used in the production of an electro-conductive member according to Example 15, particles each having a particle diameter of 3 μm or more were classified and removed with an air classifier after the removal of the coarse powder having a particle diameter of 50 μm or more.

In addition, with regard to resin particles to be used in the formation of an electro-conductive member according to Example 17, particles each having a particle diameter of 15 μm or less were classified and removed with an air classifier after the removal of the coarse powder having a particle diameter of 50 μm or more.

Resin particles to be used in the formation of electro-conductive members according to Examples 12 to 19 were produced in the same manner as in the polyisobutylene particles according to Example 1 except the foregoing.

[3. Formation of Surface Layer]

Electro-conductive members A12 to A19 were produced in the same manner as in Example 1 except that: the resin particles prepared in the section 2 were used; and the heating temperature and the heating time were changed as shown in Table 2. A molecular weight in Table 2 is a weight-average molecular weight.

TABLE 2

| Example | Material for resin particles | Manufacturer (product name) | Number of revolutions of resin particle-applying roller (rpm) | Number of revolutions of electro-conductive support (rpm) | Application time (sec) | Heating temperature (° C.) | Heating time (hour(s)) |
|---|---|---|---|---|---|---|---|
| 12 | PαMS (molecular weight: 260,000) | Manufactured by Sigma-Aldrich | 90 | 100 | 10 | 140 | 2 |
| 13 | PIB (molecular weight: 1,000,000) | Manufactured by Sigma-Aldrich | 90 | 100 | 10 | 80 | 3 |
| 14 | PIB (molecular weight: 1,000,000) | Manufactured by Sigma-Aldrich | 90 | 100 | 10 | 80 | 2 |

TABLE 2-continued

| Example | Material for resin particles | Manufacturer (product name) | Number of revolutions of resin particle-applying roller (rpm) | Number of revolutions of electro-conductive support (rpm) | Application time (sec) | Heating temperature (° C.) | Heating time (hour(s)) |
|---|---|---|---|---|---|---|---|
| 15 | PBMA (molecular weight: 337,000) | Manufactured by Sigma-Aldrich | 90 | 100 | 10 | 80 | 2 |
| 16 | PBMA (molecular weight: 337,000) | Manufactured by Sigma-Aldrich | 90 | 100 | 10 | 80 | 2 |
| 17 | PBMA (molecular weight: 337,000) | Manufactured by Sigma-Aldrich | 90 | 100 | 10 | 80 | 2 |
| 18 | PIBMA (molecular weight: 300,000) | Manufactured by Sigma-Aldrich | 90 | 100 | 10 | 80 | 2 |
| 19 | POM (molecular weight: 600,000) | Manufactured by Asahi Kasei Corporation (TENAC LA543) | 90 | 100 | 10 | 80 | 2 |

*PIB: polyisobutylene; PαMS: poly-α-methylstyrene; PBMA: polybutyl methacrylate; PIBMA: polyisobutyl methacrylate; POM: polyacetal

Example 20

When the crushed polyisobutylene was ground and classified, the crushed polyisobutylene was classified while being heated at 50° C. At this time, particles roll while their outermost surfaces are melted to some extent, and hence spherical particles can be obtained. An electro-conductive member A20 was produced in the same manner as in Example 1 except that the spherical particles were used.

Example 21

First, a polyisobutylene solution was obtained by dissolving a polyisobutylene resin in chlorobenzene. After that, p-hydroquinone (manufactured by Sigma-Aldrich) serving as a radical scavenger was added to the polyisobutylene solution so that its concentration became 5 mass %. After the mixture had been sufficiently stirred, chlorobenzene was evaporated by heating. Thus, the polyisobutylene resin to which the radical scavenger had already been added was obtained.

Next, an electro-conductive member A21 was produced in the same manner as in Example 1 except that the polyisobutylene resin to which the radical scavenger had already been added was used.

Example 22

An electro-conductive member A22 was produced in the same manner as in Example 21 except that polyisobutylene (weight-average molecular weight: 400,000, manufactured by Sigma-Aldrich) was added instead of p-hydroquinone.

Example 23

Respective materials of kinds and in amounts shown in Table 4 were mixed with a pressure kneader to provide an A-kneaded rubber composition. Further, 166 parts by mass of the A-kneaded rubber composition and respective materials of kinds and in amounts shown in Table 3 were mixed with an open roll to prepare an unvulcanized rubber composition.

TABLE 3

| | Material | Blending amount (part(s) by mass) |
|---|---|---|
| Crosslinking agent | Sulfur | 1.2 |
| Vulcanization accelerator | Tetrabenzylthiuram disulfide (product name: TBZTD, manufactured by Sanshin Chemical Industry Co., Ltd.) | 4.5 |

TABLE 4

| | Material | Blending amount (part(s) by mass) |
|---|---|---|
| Raw material rubber | NBR (product name: Nipol DN219, manufactured by Zeon Corporation) | 100 |
| Electro-conductive agent | Carbon black (product name: TOKABLACK #7360SB, manufactured by Tokai Carbon Co., Ltd.) | 40 |
| Filler | Calcium carbonate (product name: NANOX #30, manufactured by Maruo Calcium Co., Ltd.) | 20 |
| Vulcanization accelerator aid | Zinc oxide (product name: Zinc Oxide No. 2, manufactured by Sakai Chemical Industry Co., Ltd.) | 5 |
| Processing aid | Zinc stearate (product name: SZ-2000, manufactured by Sakai Chemical Industry Co., Ltd.) | 1 |

A round bar having a total length of 252 mm and an outer diameter of 6 mm was prepared by subjecting the surface of free-cutting steel to an electroless nickel plating treatment. Next, an adhesive was applied over the entire periphery of the 230-millimeter range of the round bar excluding both of its end portions each having a length of 11 mm. An electro-conductive hot-melt type adhesive was used as the adhesive. In addition, a roll coater was used in the application. The round bar having applied thereto the adhesive was used as an electro-conductive mandrel (cored bar). An electro-conductive resin layer was formed on the surface of the cored bar. A crosshead extruder having a mechanism configured to supply the electro-conductive mandrel and a mechanism configured to discharge an unvulcanized rubber roller was prepared, and a die having an inner diameter of 12.5 mm was mounted to the crosshead. The temperatures of the extruder and the crosshead were adjusted to 80° C., and the conveyance speed of the electro-conductive mandrel was adjusted to 60 mm/sec.

The unvulcanized rubber composition was formed as an elastic layer on the outer peripheral surface of the electro-conductive mandrel in the crosshead by supplying the unvulcanized rubber composition from the extruder under the foregoing conditions. Thus, an unvulcanized rubber roller was obtained. Next, the unvulcanized rubber roller was loaded into a hot-air vulcanizing furnace at 170° C., and was heated for 60 minutes to provide an unpolished electro-conductive roller. After that, the end portions of the elastic layer were cut and removed. Finally, the surface of the elastic layer was polished with a rotary grindstone. Thus, an electro-conductive roller having the following features was obtained: a diameter at each of positions distant from the central portion of the roller by 90 mm each toward both end portions thereof was 8.4 mm, and a diameter at the central portion was 8.5 mm.

An electro-conductive member A23 was produced in the same manner as in Example 1 except that the electro-conductive roller with the NBR rubber was used as an electro-conductive support.

Example 24

An electro-conductive roller was obtained by: mixing materials shown in Table 5 with an open roll to prepare an unvulcanized rubber composition; and producing an electro-conductive support from the composition through the same operation as that of Example 23.

An electro-conductive member A24 was produced in the same manner as in Example 1 except that the electro-conductive roller with the hydrin rubber was used as an electro-conductive support.

TABLE 5

| Material | Blending amount (part(s) by mass) |
|---|---|
| Epichlorohydrin-ethylene oxide-allyl glycidyl ether terpolymer (GECO) (product name: EPICHLOMER CG-102, manufactured by Daiso Co., Ltd.) | 100 |
| Zinc oxide (Zinc Oxide No. 2, manufactured by Seido Chemical Industry Co., Ltd.) | 5 |
| Calcium carbonate (product name: Silver-W, manufactured by Shiraishi Calcium Kaisha, Ltd.) | 35 |
| Carbon black (product name: SEAST SO, manufactured by Tokai Carbon Co., Ltd.) | 0.5 |
| Stearic acid (product name: Stearic acid S, manufactured by Kao Corporation) | 2 |
| Adipic acid ester (product name: POLYCIZER W305ELS, manufactured by DIC Corporation) | 10 |
| Sulfur (product name: Sulfax 200S, manufactured by Tsurumi Chemical Industry Co., Ltd.) | 0.5 |
| Dipentamethylenethiuram tetrasulfide (product name: NOCCELER TRA, manufactured by Ouchi Shinko Chemical Industrial Co., Ltd.) | 2 |
| Quaternary ammonium salt (product name: ADK CIZER LV70, manufactured by Asahi Denka Co., Ltd.) | 2 |

Example 25

First, methyl isobutyl ketone was added to a caprolactone-modified acrylic polyol solution to adjust the solid content to 10 mass %. Then, a mixed solution was prepared by using materials shown in Table 6 with respect to 1,000 parts by mass (solid content: 100 parts by mass) of the acrylic polyol solution. In this case, a mixture of blocked hexamethylene diisocyanate (HDI) and blocked isophorone diisocyanate (IPDI) had a molar ratio (NCO/OH) of an isocyanate group to a hydroxyl group of 1.0.

TABLE 6

| Material | Blending amount (part(s) by mass) |
|---|---|
| Caprolactone-modified acrylic polyol solution | 100 (solid content) |
| Carbon black (HAF) | 15 |
| Acicular rutile type titanium oxide fine particles | 35 |
| Modified dimethylsilicone oil | 0.1 |
| 7:3 mixture of butanone oxime-blocked products of hexamethylene diisocyanate (HDI) and isophorone diisocyanate (IPDI) | 80.14 |

Then, 210 g of the above-mentioned mixed solution and 200 g of glass beads having an average particle diameter of 0.8 mm serving as a medium were mixed in a 450-milliliter glass bottle, and were pre-dispersed with a paint shaker disperser for 24 hours. After that, 10 phr of non-crosslinked acrylic particles (model: MX-500, manufactured by Soken Chemical & Engineering Co., Ltd.) and 200 g of glass beads having an average particle diameter of 0.8 mm serving as a medium were mixed, and were dispersed with a paint shaker disperser for 10 minutes to provide a paint for forming an electro-conductive resin layer. The unit "phr" means an addition amount (part(s) by mass) with respect to 100 parts by mass of an unvulcanized rubber composition.

The paint for forming an electro-conductive resin layer was applied to the electro-conductive support A1 by a dipping method involving dipping the support in the paint with its longitudinal direction being directed in a vertical direction. In the dipping application, a dipping time was 9 seconds, and a pulling speed was linearly changed with time from an initial speed of 20 mm/sec to a final speed of 2 mm/sec. The resultant applied product was air-dried at normal temperature for 30 minutes, and was then dried in a hot-air circulating dryer set to a temperature of 90° C. for 1 hour and further dried in the hot-air circulating dryer set to a temperature of 160° C. for 1 hour.

After that, a surface layer was formed in the same manner as in Example 1. Thus, an electro-conductive member A25 was produced.

Example 26

An electro-conductive member A26 was produced by mounting a separating member (a ring having an outer diameter of 8.6 mm, an inner diameter of 6 mm, and a width of 2 mm in each end portion of the electro-conductive resin layer) to the electro-conductive member A1.

Comparative Example 1

An electro-conductive member C1 was produced in the same manner as in Example 25 except that the surface layer was not formed.

Comparative Example 2

An electro-conductive member C2 was produced in the same manner as in Example 1 except that the heating was not performed after the formation of the surface layer.

Comparative Example 3

An electro-conductive member C3 was produced in the same manner as in Example 1 except that carbon particles (PC1020 manufactured by Nippon Carbon Co., Ltd.) were used as particles.

Comparative Example 4

An electro-conductive member C4 was produced in the same manner as in Example 1 except that the classification with the Fine Mill was performed so that the average of the circle-equivalent diameters of the particles of the surface layer became 35 μm.

Comparative Example 5

An electro-conductive member C5 was produced in the same manner as in Example 1 except that the heating temperature of the surface layer was changed to 150° C.

Comparative Example 6

An electro-conductive member C6 was produced in the same manner as in Example 1 except that the material for the particles of the surface layer was changed to polystyrene (Sigma-Aldrich, product having a weight-average molecular weight of 260,000).

The electro-conductive members A1 to A26 according to Examples 1 to 26 and the electro-conductive members C1 to C6 according to Comparative Examples 1 to 6 were subjected to the evaluations 4-1 to 4-10 and the evaluations 5-1 to 5-3 described in Example 1. The results are shown in Table 7-1 to Table 7-6 and Table 8. The contents of the respective tables are as described below.

Table 7-1: The results of the evaluations 4-1 to 4-4 of Examples 1 to 18 are shown in the table.

Table 7-2: The results of the evaluations 4-5 to 4-10 of Examples 1 to 18 are shown in the table.

Table 7-3: The results of the evaluations 4-1 to 4-4 of Examples 19 to 26 are shown in the table.

Table 7-4: The results of the evaluations 4-5 to 4-10 of Examples 19 to 26 are shown in the table.

Table 7-5: The results of the evaluations 4-1 to 4-4 of Comparative Examples 1 to 6 are shown in the table.

Table 7-6: The results of the evaluations 4-5 to 4-10 of Comparative Examples 1 to 6 are shown in the table.

Table 8: The results of the evaluations 5-1 to 5-3 of Examples 1 to 26 and Comparative Examples 1 to 6 are shown in the table.

The electro-conductive member C1 according to Comparative Example 1 was not subjected to the evaluations 4-1 to 4-10 because the member did not have any surface layer. The symbol "–" was described in columns corresponding to the evaluations in Table 7-5 and Table 7-6 to be described later.

Further, the surface layer of the electro-conductive member C5 according to Comparative Example 5 was a film free of any neck, and hence the symbol "–" was described in the column "Average D2 of circle-equivalent diameters of sections of necks" according to the evaluation 4-6 in Table 7-6.

TABLE 7-1

| | | | | | Volume resistivity of surface layer | | | Quantity of accumulated charge of surface layer | | |
|---|---|---|---|---|---|---|---|---|---|---|
| | | Presence or absence of three-dimensionally continuous skeleton and pores communicating in thickness direction | Presence or absence of necks | Number of squares each having through-hole (square(s)) | Before endurance (Ω · cm) | After endurance (Ω · cm) | Reduction ratio between volume resistivities before and after endurance (%) | Before endurance (V) | After endurance (V) | Reduction ratio between charge quantities before and after endurance (%) |
| Example | 1 | Y | Y | A (0) | 1.7E+15 | 1.6E+15 | 5.4 | 185 | 175 | 5% |
| | 2 | Y | Y | A (2) | 4E+15 | 3.8E+15 | 4.0 | 200 | 192 | 4% |
| | 3 | Y | Y | A (1) | 3.3E+15 | 3.1E+15 | 5.9 | 152 | 143 | 6% |
| | 4 | Y | Y | A (0) | 8.3E+15 | 8.0E+15 | 3.6 | 192 | 185 | 4% |
| | 5 | Y | Y | A (0) | 3.7E+15 | 3.5E+15 | 6.1 | 362 | 340 | 6% |
| | 6 | Y | Y | A (1) | 9.5E+15 | 9.0E+15 | 5.1 | 455 | 432 | 5% |
| | 7 | Y | Y | A (0) | 3.4E+15 | 3.3E+15 | 3.5 | 171 | 165 | 4% |
| | 8 | Y | Y | A (4) | 3.5E+15 | 3.2E+15 | 9.1 | 330 | 300 | 9% |
| | 9 | Y | Y | A (2) | 1.2E+15 | 1.1E+15 | 5.0 | 121 | 115 | 5% |
| | 10 | Y | Y | A (0) | 3.8E+15 | 3.7E+15 | 1.9 | 311 | 305 | 2% |
| | 11 | Y | Y | B (8) | 6.4E+15 | 5.9E+15 | 8.6 | 105 | 96 | 9% |
| | 12 | Y | Y | A (0) | 3E+16 | 2.7E+16 | 10.1 | 178 | 160 | 10% |
| | 13 | Y | Y | A (0) | 3.3E+15 | 3.2E+15 | 3.3 | 181 | 175 | 3% |
| | 14 | Y | Y | A (0) | 3.9E+15 | 3.5E+15 | 11.0 | 164 | 146 | 11% |
| | 15 | Y | Y | A (2) | 8.8E+14 | 7.4E+14 | 15.9 | 113 | 95 | 16% |
| | 16 | Y | Y | A (0) | 2.8E+14 | 2.5E+14 | 12.0 | 100 | 88 | 12% |
| | 17 | Y | Y | A (3) | 1E+14 | 8.6E+13 | 13.6 | 81 | 70 | 14% |
| | 18 | Y | Y | A (1) | 8E+10 | 6.3E+10 | 17.3 | 52 | 43 | 17% |

TABLE 7-2

| | | Average D1 of circle-equivalent diameters of particles (μm) | Average D2 of circle-equivalent diameters of sections of necks (μm) | D2/D1 | Film thickness (μm) | Film thickness/D1 | Porosity (%) | Particle shape | Tg (° C.) | Judgment as to whether or not resin forming surface layer is radiation degradable resin |
|---|---|---|---|---|---|---|---|---|---|---|
| Example | 1 | 3.5 | 2.36 | 0.67 | 15 | 4.3 | 56 | Deformed shape | −70 | Y |
| | 2 | 0.2 | 0.13 | 0.65 | 1 | 5.0 | 46 | Deformed shape | −70 | Y |
| | 3 | 0.2 | 0.10 | 0.52 | 0.8 | 4.0 | 66 | Deformed shape | −70 | Y |
| | 4 | 4.2 | 2.23 | 0.53 | 20 | 4.8 | 50 | Deformed shape | −70 | Y |
| | 5 | 4.8 | 2.11 | 0.44 | 45 | 9.4 | 52 | Deformed shape | −70 | Y |
| | 6 | 5.8 | 3.36 | 0.58 | 57 | 9.8 | 65 | Deformed shape | −70 | Y |
| | 7 | 18 | 6.12 | 0.34 | 27 | 1.5 | 25 | Deformed shape | −70 | Y |
| | 8 | 19 | 9.88 | 0.52 | 45 | 2.4 | 68 | Deformed shape | −70 | Y |
| | 9 | 3.2 | 0.74 | 0.23 | 4 | 1.3 | 11 | Deformed shape | −70 | Y |
| | 10 | 3.8 | 1.44 | 0.38 | 40 | 10.5 | 56 | Deformed shape | −70 | Y |
| | 11 | 3.2 | 0.93 | 0.29 | 3.5 | 1.1 | 25 | Deformed shape | −70 | Y |
| | 12 | 4.5 | 1.08 | 0.24 | 13 | 2.9 | 60 | Deformed shape | 107 | Y |
| | 13 | 4.2 | 0.34 | 0.08 | 16 | 3.8 | 54 | Deformed shape | −70 | Y |
| | 14 | 3.8 | 3.04 | 0.8 | 15 | 3.9 | 56 | Deformed shape | −70 | Y |
| | 15 | 0.2 | 0.10 | 0.48 | 1 | 5.0 | 63 | Deformed shape | 15 | Y |
| | 16 | 5.9 | 3.78 | 0.64 | 20 | 3.4 | 45 | Deformed shape | 15 | Y |
| | 17 | 19 | 6.84 | 0.36 | 48 | 2.5 | 45 | Deformed shape | 15 | Y |
| | 18 | 5.6 | 2.13 | 0.38 | 19 | 3.4 | 62 | Deformed shape | 35 | Y |

TABLE 7-3

| | | Presence or absence of three-dimensionally continuous skeleton and pores communicating in thickness direction | Presence or absence of necks | Number of squares each having through-hole (square(s)) | Volume resistivity of surface layer | | | Quantity of accumulated charge of surface layer | | |
|---|---|---|---|---|---|---|---|---|---|---|
| | | | | | Before endurance (Ω · cm) | After endurance (Ω · cm) | Reduction ratio between volume resistivities before and after endurance (%) | Before endurance (V) | After endurance (V) | Reduction ratio between charge quantities before and after endurance (%) |
| Example | 19 | Y | Y | A (0) | 6.20E+15 | 5.8E+15 | 6.5 | 170 | 160 | 5% |
| | 20 | Y | Y | B (12) | 6.9E+15 | 4.9E+15 | 29.0 | 183 | 130 | 29% |
| | 21 | Y | Y | A (0) | 9E+15 | 9.0E+15 | 0.0 | 190 | 190 | 0% |
| | 22 | Y | Y | B (15) | 5.6E+15 | 5.6E+15 | 0.0 | 185 | 185 | 0% |
| | 23 | Y | Y | B (20) | 7.1E+15 | 6.1E+15 | 13.4 | 179 | 155 | 13% |
| | 24 | Y | Y | A (3) | 7.5E+15 | 6.9E+15 | 8.6 | 175 | 160 | 9% |
| | 25 | Y | Y | A (1) | 5.5E+15 | 5.5E+15 | 0.6 | 176 | 175 | 1% |
| | 26 | Y | Y | A (0) | 7E+15 | 7.0E+15 | 0.6 | 177 | 176 | 1% |

TABLE 7-4

| | | Average D1 of circle-equivalent diameters of particles (μm) | Average D2 of circle-equivalent diameters of sections of necks (μm) | D2/D1 | Film thickness (μm) | Film thickness/D1 | Porosity (%) | Particle shape | Tg (° C.) | Judgment as to whether or not resin forming surface layer is radiation degradable resin |
|---|---|---|---|---|---|---|---|---|---|---|
| Example | 19 | 3.5 | 2.15 | 0.61 | 15 | 4.29 | 42 | Deformed shape | −50 | Y |
| | 20 | 4.5 | 1.94 | 0.43 | 15 | 3.3 | 56 | Spherical | −70 | Y |
| | 21 | 5.4 | 1.19 | 0.22 | 18 | 3.3 | 50 | Deformed shape | −70 | Y |
| | 22 | 5.7 | 3.19 | 0.56 | 12 | 2.1 | 60 | Deformed shape | −70 | Y |
| | 23 | 5.2 | 3.48 | 0.67 | 14 | 2.7 | 55 | Deformed shape | −70 | Y |
| | 24 | 4.8 | 3.36 | 0.7 | 12 | 2.5 | 61 | Deformed shape | −70 | Y |

TABLE 7-4-continued

| | Average D1 of circle-equivalent diameters of particles (μm) | Average D2 of circle-equivalent diameters of sections of necks (μm) | D2/D1 | Film thickness (μm) | Film thickness/D1 | Porosity (%) | Particle shape | Tg (° C.) | Judgment as to whether or not resin forming surface layer is radiation degradable resin |
|---|---|---|---|---|---|---|---|---|---|
| 25 | 5.9 | 1.12 | 0.19 | 13 | 2.2 | 69 | Deformed shape | −70 | Y |
| 26 | 3.8 | 1.29 | 0.34 | 17 | 4.5 | 48 | Deformed shape | −70 | Y |

TABLE 7-5

| | | Presence or absence of three-dimensionally continuous skeleton and pores communicating in thickness direction | Presence or absence of necks | Number of squares each having through-hole (square(s)) | Volume resistivity of surface layer: Before endurance (Ω · cm) | Volume resistivity of surface layer: After endurance (Ω · cm) | Volume resistivity of surface layer: Reduction ratio between volume resistivities before and after endurance (%) | Quantity of accumulated charge of surface layer: Before endurance (V) | Quantity of accumulated charge of surface layer: After endurance (V) | Quantity of accumulated charge of surface layer: Reduction ratio between charge quantities before and after endurance (%) |
|---|---|---|---|---|---|---|---|---|---|---|
| Comparative Example | 1 | — | — | — | — | — | — | 0 | 0 | — |
| | 2 | Y | — | D (152) | 5.8E+15 | 5.3E+15 | 8.3 | 180 | 165 | 8.0 |
| | 3 | Y | Y | A (1) | 1.2 × 10^3 | 1.2 × 10^3 | 0.0 | 0 | 0 | — |
| | 4 | Y | Y | A (2) | 2.5E+15 | 2.3E+15 | 6.5 | 123 | 115 | 6.9 |
| | 5 | Y | N | A (0) | 3.8E+15 | 4.8E+14 | 87.4 | 182 | 150 | 82 |
| | 6 | Y | Y | A (2) | 3.3E+15 | 3.6E+11 | 99.99 | 183 | 2 | 99.99 |

TABLE 7-6

| | | Average D1 of circle-equivalent diameters of particles (μm) | Average D2 of circle-equivalent diameters of sections of necks (μm) | D2/D1 | Film thickness (μm) | Film thickness/D1 | Porosity (%) | Particle shape | Tg (° C.) | Judgment as to whether or not resin forming surface layer is radiation degradable resin |
|---|---|---|---|---|---|---|---|---|---|---|
| Comparative Example | 1 | — | — | — | — | — | — | — | — | — |
| | 2 | 3.7 | — | 0.6 | 19 | 5.1 | 70 | Deformed shape | −70 | Y |
| | 3 | 4.5 | 2.84 | 0.63 | 13 | 2.9 | 52 | Deformed shape | — | — |
| | 4 | 35 | 5.95 | 0.17 | 45 | 1.3 | 16 | Deformed shape | −70 | Y |
| | 5 | 5.5 | — | — | 13 | — | 0 | Deformed shape | −70 | Y |
| | 6 | 3.7 | 1.18 | 0.32 | 14 | 3.8 | 67 | Deformed shape | 100 | N |

TABLE 8

| | Voltage V1 at which blank dot occurs (V) | White spot | Black spot |
|---|---|---|---|
| Example 1 | 1,920 | A | A |
| Example 2 | 1,970 | A | A |
| Example 3 | 1,850 | A | A |
| Example 4 | 1,920 | A | A |
| Example 5 | 1,920 | A | B |
| Example 6 | 1,920 | A | C |
| Example 7 | 1,920 | A | B |
| Example 8 | 1,920 | A | C |
| Example 9 | 1,870 | B | B |
| Example 10 | 1,920 | A | B |
| Example 11 | 1,800 | B | B |
| Example 12 | 1,980 | C | A |
| Example 13 | 1,890 | A | A |

TABLE 8-continued

| | Voltage V1 at which blank dot occurs (V) | White spot | Black spot |
|---|---|---|---|
| Example 14 | 1,920 | A | B |
| Example 15 | 1,780 | B | B |
| Example 16 | 1,750 | B | B |
| Example 17 | 1,740 | B | C |
| Example 18 | 1,650 | C | C |
| Example 19 | 2,000 | A | A |
| Example 20 | 1,920 | A | B |
| Example 21 | 1,920 | A | A |
| Example 22 | 1,920 | A | A |
| Example 23 | 1,850 | A | B |
| Example 24 | 1,820 | A | B |
| Example 25 | 2,120 | A | A |
| Example 26 | 2,100 | A | A |

TABLE 8-continued

| | Voltage V1 at which blank dot occurs (V) | White spot | Black spot |
|---|---|---|---|
| Comparative Example 1 | 1,050 | A | D |
| Comparative Example 2 | 1,520 | D | D |
| Comparative Example 3 | 850 | A | D |
| Comparative Example 4 | 1,800 | D | D |
| Comparative Example 5 | 1,020 | B | D |
| Comparative Example 6 | 1,820 | A | D |

Example 27

Example 27 to Example 40 are each an example of a configuration including an intermediate layer containing a radiation degradable resin.

[Formation of Intermediate Layer]

The intermediate layer was formed as described below.

First, an application liquid 1 was obtained by dissolving poly(t-butyl methacrylate) (manufactured by Sigma-Aldrich, product having a weight-average molecular weight of 170,000) at a concentration of 1 mass % in dimethylacetylamide.

The application liquid 1 was applied to the electro-conductive support A1 by a dipping method involving dipping the support in the liquid with its longitudinal direction being directed in a vertical direction. In the dipping application, a dipping time was 9 seconds, and a pulling speed was linearly changed with time from an initial speed of 20 mm/sec to a final speed of 2 mm/sec. The resultant applied product was air-dried at normal temperature for 30 minutes, and was dried in a hot-air circulating dryer set to a temperature of 160° C. for 1 hour to provide an electro-conductive support B1.

[Evaluation 6-1. Evaluation of Non-Electro-Conductivity of Intermediate Layer]

The evaluation of the non-electro-conductivity of the intermediate layer was performed by the following method. The volume resistivity of the intermediate layer was measured with a scanning probe microscope (SPM) (product name: Q-Scope 250, manufactured by Quesant Instrument Corporation) by a contact mode.

First, the electro-conductive support was equally divided into 10 regions in a longitudinal direction thereof, and from each of the 10 regions, 10 of test pieces were sampled by a focused ion beam method. Each of the test pieces has a segment of the intermediate layer having a length of 1 mm in an x-axis direction, a length of 500 μm in a y-axis direction, and a depth of 700 μm including the electro-conductive support A1 in a z-axis direction. Next, each of the test piece was placed on a metal plate made of stainless steel to provide measurement segments. Next, regarding each of the measurement segments, the cantilever of the SPM was brought into contact with an intermediate layer of the test piece, and a current value was measured by applying a voltage of 50 V to the cantilever.

Next, a yz section of each of the test pieces was observed and the thickness of the intermediate layer was measured. Further, a volume resistivity was calculated from the thickness and the current value. An average value of the volume resistivity of the respective test pieces was defined as a volume resistivity of the intermediate layer in the evaluation 6-1.

[Evaluation 6-2. Measurement of Thickness of Intermediate Layer]

Average of values of the intermediate layers' thickness measured in the afore-mentioned Evaluation 6-1, was defined as the thickness of the intermediate layer in this evaluation.

[Evaluation 6-3. Evaluation as to Whether or not Intermediate Layer is Radiation Degradable Resin; Evaluation of Glass Transition Temperature Tg]

A judgment as to whether or not a resin forming the intermediate layer was a radiation degradable resin, and the evaluation of a glass transition temperature Tg were performed by the same methods as those for the evaluations in a surface layer except that the intermediate layer was peeled from the electro-conductive support B1 and provided as a test piece.

[Formation of Surface Layer on Outer Periphery of Intermediate Layer]

The electro-conductive support B1 was used instead of the electro-conductive support A1. Further, polystyrene (manufactured by Sigma-Aldrich, weight-average molecular weight: 260,000) was used as the particles of a surface layer, and a heating temperature and a heating time after the deposition of the particles were set to 140° C. and 3 hours, respectively. An electro-conductive member B1 was produced in the same manner as in Example 1 except the foregoing.

The electro-conductive member B1 obtained in this example was subjected to the evaluations 4-1 to 4-10 and the evaluations 5-1 to 5-3 described in Example 1.

Examples 28 to 40

Electro-conductive members B2 to B14 were produced in the same manner as in Example 27 except that the application liquid 1 was changed to application liquids 2 to 14 shown in Table 9 below. Intermediate layers according to the electro-conductive members B2 to B14 were subjected to the evaluations 6-1 to 6-3 described in Example 27.

In addition, the electro-conductive members B2 to B14 were subjected to the evaluations 4-1 to 4-10 and the evaluations 5-1 to 5-3 described in Example 1.

TABLE 9

| | | Application liquid No. | Material | Manufacturer (product name) | Solvent | Solid content concentration (wt %) |
|---|---|---|---|---|---|---|
| Example | 28 | 2 | PtBMA (product having a molecular weight of 170,000) | Manufactured by Sigma-Aldrich | DMAC | 1 |
| | 29 | 3 | | | DMAC | 5 |
| | 30 | 4 | | | DMAC | 10 |
| | 31 | 5 | PMMA (product having a molecular weight of 996,000) | Manufactured by Sigma-Aldrich | DMAC | 5 |
| | 32 | 6 | PEMA (product having a molecular weight of 850,000) | Manufactured by Sigma-Aldrich | DMAC | 5 |
| | 33 | 7 | PBMA (product having a molecular weight of 337,000) | Manufactured by Sigma-Aldrich | DMAC | 5 |
| | 34 | 8 | PiBMA (product having a molecular weight of 300,000) | Manufactured by Sigma-Aldrich | DMAC | 5 |
| | 35 | 9 | PiPMA (product having a molecular weight of 100,000) | Manufactured by Sigma-Aldrich | DMAC | 5 |
| | 36 | 10 | P(B-iB)MA (product having a molecular weight of 354,000) | Manufactured by Sigma-Aldrich | DMAC | 5 |
| | 37 | 11 | P(B-E)MA (product having a molecular weight of 150,000) | Manufactured by Sigma-Aldrich | DMAC | 5 |
| | 38 | 12 | PCMA (product having a molecular weight of 65,000) | Manufactured by Sigma-Aldrich | Mixed solvent containing chlorobenzene and DMAC at a weight ratio of 1:1 | 5 |
| | 39 | 13 | POM (product having a molecular weight of 600,000) | Manufactured by Asahi Kasei Corporation (TENAC LA543) | HFIP | 5 |
| | 40 | 14 | PMS (product having a molecular weight of 150,000) | Manufactured by Sigma-Aldrich | DMAC | 5 |

In Table 9, the molecular weight shown in the "Material" column is a weight-average molecular weight. In addition, the details of material abbreviations shown in the column are as follows:

PtBMA: poly-t-butyl methacrylate ($R^1$: —$C(CH_3)_3$),
PMMA: polymethyl methacrylate ($R^1$: —$CH_3$),
PEMA: polyethyl methacrylate ($R^1$: —$CH_2CH_3$),
PBMA: polybutyl methacrylate ($R^1$: —$CH_2CH_2CH_2CH_3$),
PiBMA: polyisobutyl methacrylate ($R^1$: —$CH_2CH(CH_3)_2$),
PiPMA: polyisopropyl methacrylate ($R^1$: —$CH(CH_3)_2$),
P(B-iB)MA: butyl methacrylate-isobutyl methacrylate copolymer,
P(B-E)MA: butyl methacrylate-ethyl methacrylate copolymer,
PαMS: poly-α-methylstyrene,
PCMA: polycyclohexyl methacrylate ($R^1$: -Cy),
POM: polyacetal, and
HFIP: 1,1,1,3,3,3-hexafluoro-2-propanol.

Example 41

An electro-conductive member B15 was produced by: producing an intermediate layer in the same manner as in Example 27; and then forming a surface layer in the same manner as in Example 1. The intermediate layer according to the electro-conductive member B15 was subjected to the evaluations 6-1 to 6-3 described in Example 27.

In addition, the electro-conductive member B15 was subjected to the evaluations 4-1 to 4-10 and the evaluations 5-1 to 5-3 described in Example 1.

Comparative Example 7

An electro-conductive member C7 was produced in the same manner as in Example 27 except that polystyrene (Sigma-Aldrich, product having a weight-average molecular weight of 260,000) was used as each of both a material for the particles of its surface layer and a material for its intermediate layer. The intermediate layer according to the electro-conductive member C7 was subjected to the evaluations 6-1 to 6-3 described in Example 27.

In addition, the electro-conductive member C7 was subjected to the evaluations 4-1 to 4-10 and the evaluations 5-1 to 5-3 described in Example 1.

Comparative Example 8

An electro-conductive member C8 was produced in the same manner as in Example 27 except that a quaternary ammonium salt (product name: ADK CIZER LV70, manufactured by Asahi Denka Co., Ltd.) was added as an ionic conductivity-imparting agent at a concentration of 5 mass % to the application liquid 1. The intermediate layer according to the electro-conductive member C8 was subjected to the evaluations 6-1 to 6-3 described in Example 27.

In addition, the electro-conductive member C8 was subjected to the evaluations 4-1 to 4-10 and the evaluations 5-1 to 5-3 described in Example 1.

The evaluation results of the evaluations 6-1 to 6-3 for Examples 27 to 41 and Comparative Examples 7 and 8 are shown in Table 10. In addition, the evaluation results of the evaluations 4-1 to 4-10 are shown in Table 11-1 and Table 11-2. Further, the evaluation results of the evaluations 5-1 to 5-3 are shown in Table 12.

TABLE 10

| | Tg (° C.) | Judgment as to whether or not resin forming intermediate layer is radiation degradable resin | Film thickness (μm) | Volume resistivity of intermediate layer: Before endurance (Ω · cm) | After endurance (Ω · cm) | Reduction ratio (%) |
|---|---|---|---|---|---|---|
| Example 27 | 107 | Y | 0.5 | 2.2E+15 | 2.2E+15 | 1 |
| Example 28 | 107 | Y | 1 | 3.2E+15 | 3.2E+15 | 1 |
| Example 29 | 107 | Y | 5 | 2.5E+15 | 2.5E+15 | 1 |
| Example 30 | 107 | Y | 10 | 1.7E+15 | 1.7E+15 | 1 |
| Example 31 | 110 | Y | 5 | 1.5E+16 | 1.5E+16 | 1.5 |
| Example 32 | 63 | Y | 5 | 2.5E+14 | 2.2E+14 | 11 |
| Example 33 | 15 | Y | 5 | 8.5E+13 | 6.5E+13 | 24 |
| Example 34 | 55 | Y | 5 | 3.2E+12 | 2.0E+12 | 38 |
| Example 35 | 80 | Y | 5 | 2.5E+14 | 2.2E+14 | 11 |
| Example 36 | 35 | Y | 5 | 1.1E+11 | 1.0E+11 | 8.5 |
| Example 37 | 52 | Y | 5 | 6.2E+14 | 4.7E+14 | 23.5 |
| Example 38 | 104 | Y | 5 | 5.5E+14 | 4.0E+14 | 28 |
| Example 39 | 104 | Y | 5 | 2.5E+15 | 1.6E+15 | 35 |
| Example 40 | −35 | Y | 3 | 3.30E+15 | 2.7E+15 | 18 |
| Example 41 | 107 | Y | 2 | 5.5E+15 | 5.4E+15 | 2 |
| Comparative Example 7 | 100 | N | 5 | 1.5E+15 | 2.5E+11 | 99.9 |
| Comparative Example 8 | 100 | Y | 5 | 1.20E+06 | 1.20E+06 | 0 |

25

TABLE 11-1

| | Presence or absence of three-dimensionally continuous skeleton and pores communicating in thickness direction | Presence or absence of necks | Number of squares each having through-hole (square(s)) | Volume resistivity of surface layer: Before endurance (Ω · cm) | After endurance (Ω · cm) | Reduction ratio between volume resistivities before and after endurance (%) | Quantity of accumulated charge of surface layer (V): Before endurance (V) | After endurance (V) | Reduction ratio between charge quantities before and after endurance (%) |
|---|---|---|---|---|---|---|---|---|---|
| Example 27 | Y | Present | B (22) | 1E+15 | 9.5E+14 | 5.3 | 181 | 172 | 5% |
| Example 28 | Y | Present | A (0) | 6.1E+15 | 6.0E+15 | 1.0 | 182 | 180 | 1% |
| Example 29 | Y | Present | A (0) | 1.1E+15 | 1.1E+15 | 1.0 | 182 | 180 | 1% |
| Example 30 | Y | Present | A (2) | 9E+15 | 8.9E+15 | 1.0 | 179 | 177 | 1% |
| Example 31 | Y | Present | A (0) | 7.6E+15 | 7.4E+15 | 3.1 | 180 | 175 | 3% |
| Example 32 | Y | Present | A (1) | 8.6E+15 | 7.3E+15 | 17.6 | 181 | 154 | 15% |
| Example 33 | Y | Present | B (10) | 3.4E+15 | 2.6E+15 | 33.3 | 182 | 137 | 25% |
| Example 34 | Y | Present | A (4) | 8.1E+15 | 5.4E+15 | 49.3 | 180 | 121 | 33% |
| Example 35 | Y | Present | B (25) | 1.9E+15 | 1.7E+15 | 11.1 | 183 | 165 | 10% |
| Example 36 | Y | Present | B (11) | 5.3E+15 | 4.8E+15 | 11.1 | 181 | 163 | 10% |
| Example 37 | Y | Present | A (0) | 6.2E+15 | 4.8E+15 | 28.2 | 181 | 141 | 22% |
| Example 38 | Y | Present | A (2) | 3.3E+15 | 2.5E+15 | 33.3 | 185 | 139 | 25% |
| Example 39 | Y | Present | A (0) | 6.6E+15 | 4.7E+15 | 39.2 | 181 | 130 | 28% |
| Example 40 | Y | Present | A (0) | 4.50E+15 | 4.2E+15 | 7.1 | 180 | 152 | 16% |
| Example 41 | Y | Present | A (1) | 6.5E+15 | 6.2E+15 | 5.3 | 180 | 171 | 5% |
| Comparative Example 7 | N | Present | B (16) | 1.7E+15 | 2.8E+11 | 99.9 | 183 | 3 | 98% |
| Comparative Example 8 | Y | Present | A (2) | 2.80E+15 | 7.7E+11 | 99.9 | 182 | 5 | 97% |

TABLE 11-2

| | Average D1 of circle-equivalent diameters of particles (μm) | Average D2 of circle-equivalent diameters of sections of necks (μm) | D2/D1 | Film thickness (μm) | Film thickness/D1 | Porosity (%) | Particle shape | Tg (° C.) | Judgment as to whether or not resin forming surface layer is radiation degradable resin |
|---|---|---|---|---|---|---|---|---|---|
| Example 27 | 3.7 | 1.00 | 0.27 | 15 | 4.1 | 48 | Deformed shape | 100 | N |
| Example 28 | 4.6 | 2.76 | 0.6 | 17 | 3.7 | 54 | Deformed shape | 100 | N |
| Example 29 | 2.2 | 0.64 | 0.29 | 14 | 6.4 | 68 | Deformed shape | 100 | N |

TABLE 11-2-continued

| | Average D1 of circle-equivalent diameters of particles (μm) | Average D2 of circle-equivalent diameters of sections of necks (μm) | D2/D1 | Film thickness (μm) | Film thickness/D1 | Porosity (%) | Particle shape | Tg (° C.) | Judgment as to whether or not resin forming surface layer is radiation degradable resin |
|---|---|---|---|---|---|---|---|---|---|
| Example 30 | 5.7 | 3.42 | 0.6 | 13 | 2.3 | 64 | Deformed shape | 100 | N |
| Example 31 | 5.3 | 1.70 | 0.32 | 19 | 3.6 | 57 | Deformed shape | 100 | N |
| Example 32 | 4.2 | 2.65 | 0.63 | 16 | 3.8 | 56 | Deformed shape | 100 | N |
| Example 33 | 3.6 | 2.34 | 0.65 | 18 | 5.0 | 67 | Deformed shape | 100 | N |
| Example 34 | 2.4 | 0.55 | 0.23 | 17 | 7.1 | 63 | Deformed shape | 100 | N |
| Example 35 | 4.8 | 0.53 | 0.11 | 16 | 3.3 | 46 | Deformed shape | 100 | N |
| Example 36 | 3.2 | 2.24 | 0.7 | 14 | 4.4 | 69 | Deformed shape | 100 | N |
| Example 37 | 4.6 | 0.78 | 0.17 | 18 | 3.9 | 61 | Deformed shape | 100 | N |
| Example 38 | 3.5 | 2.03 | 0.58 | 12 | 3.4 | 62 | Deformed shape | 100 | N |
| Example 39 | 4.4 | 1.10 | 0.25 | 12 | 2.7 | 67 | Deformed shape | 100 | N |
| Example 40 | 4.6 | 1.23 | 0.35 | 13 | 2.8 | 66 | Deformed shape | 100 | N |
| Example 41 | 2.8 | 1.26 | 0.45 | 12 | 4.3 | 58 | Deformed shape | −70 | Y |
| Comparative Example 7 | 3.1 | 1.80 | 0.58 | 13 | 4.2 | 59 | Deformed shape | 100 | N |
| Comparative Example 8 | 4.5 | 1.94 | 0.43 | 14 | 3.1 | 66 | Deformed shape | 100 | N |

TABLE 12

| | Black spot | Voltage V1 at which blank dot occurs (V) | White spot |
|---|---|---|---|
| Example 27 | A | 2,050 | A |
| Example 28 | A | 2,050 | A |
| Example 29 | A | 2,050 | A |
| Example 30 | A | 2,050 | A |
| Example 31 | A | 2,050 | A |
| Example 32 | B | 2,050 | A |
| Example 33 | B | 2,050 | A |
| Example 34 | C | 2,050 | A |
| Example 35 | B | 2,050 | A |
| Example 36 | B | 2,050 | A |
| Example 37 | B | 2,050 | A |
| Example 38 | B | 2,050 | A |
| Example 39 | C | 2,050 | A |
| Example 40 | B | 2,050 | A |
| Example 41 | A | 2,050 | A |
| Comparative Example 7 | D | 1,830 | A |
| Comparative Example 8 | D | 1,830 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-187635, filed Sep. 26, 2016 and Japanese Patent Application No. 2017-156049, filed Aug. 10, 2017 which are hereby incorporated by reference herein in their entirety.

What is claimed is:

1. An electro-conductive member for electrophotography, comprising:

an electro-conductive support; and a surface layer formed on the electro-conductive support, the surface layer having a three-dimensionally continuous skeleton and pores communicating in a thickness direction thereof, wherein when an arbitrary 150-micrometer square region of a surface of the surface layer is photographed and the region is equally divided into 3,600 squares by two sets of lines at right angles, a number of squares each including a through-hole is 100 or less, the skeleton is non-electro-conductive and includes a plurality of resin particles bonded to each other through necks, the resin particles each contains a radiation degradable resin comprising at least one selected from the group consisting of polyisobutylene, poly(α-methylstyrene), polybutyl methacrylate, polyisobutyl methacrylate and polyacetal, and an average D1 of circle-equivalent diameters of the resin particles is 0.1 to 20 μm.

2. An electro-conductive member for electrophotography according to claim 1, wherein the radiation degradable resin has a glass transition temperature Tg of −150 to 100° C.

3. An electro-conductive member for electrophotography according to claim 1, wherein an average D2 of circle-equivalent diameters of sections of the necks is 0.1 to 0.7 times as large as the average D1.

4. An electro-conductive member for electrophotography according to claim 1, wherein the surface layer has a thickness of 1 to 30 μm.

5. An electro-conductive member for electrophotography according to claim 1, wherein the surface layer has a volume resistivity of $1\times10^{12}$ to $1\times10^{17}$ Ω·cm.

6. An electro-conductive member for electrophotography according to claim 1, wherein the surface layer has a porosity of 20 to 80%.

7. An electro-conductive member for electrophotography according to claim 1, wherein the electro-conductive member comprises a rigid structure configured to protect the surface layer.

8. An electro-conductive member for electrophotography, comprising in this order:

an electro-conductive support;

an intermediate layer; and a surface layer, the surface layer having a three-dimensionally continuous skeleton and pores communicating in a thickness direction thereof, wherein when an arbitrary 150-micrometer square region of a surface of the surface layer is photographed and the region is equally divided into 3,600 squares by two sets of lines at right angles, a number of squares each including a through-hole is 100 or less, the skeleton is non-electro-conductive and includes a plurality of resin particles bonded to each other through necks, an average D1 of circle-equivalent diameters of the resin particles is 0.1 to 20 μm, and the intermediate layer contains a radiation degradable resin and is non-electro-conductive.

9. An electro-conductive member for electrophotography according to claim 8, wherein the intermediate layer has a volume resistivity of $1\times10^{12}$ to $1\times10^{17}$ Ω·cm.

10. An electro-conductive member for electrophotography according to claim 9, wherein the intermediate layer has a volume resistivity of $1\times10^{15}$ to $1\times10^{17}$ Ω·cm.

11. An electro-conductive member for electrophotography according to claim 8, wherein the radiation degradable resin comprises an acrylic resin having a constituent unit represented by formula (1)

(1)

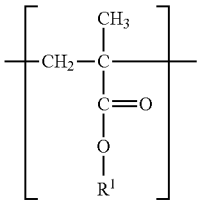

where $R^1$ represents a hydrocarbon group having 1 to 6 carbon atoms.

12. An electro-conductive member for electrophotography according to claim 11, wherein $R^1$ represents a linear or branched alkyl group having 2 to 6 carbon atoms.

13. An electro-conductive member for electrophotography according to claim 11, wherein $R^1$ is at least one of —$C(CH_3)_3$, —$CH(CH_3)_2$, —$CH(CH_3)$—$C(CH_3)_3$ or —$C(CH_3)_2$—$CH(CH_3)_2$.

14. An electro-conductive member for electrophotography according to claim 11, wherein $R^1$ is —$C(CH_3)_3$.

15. An electro-conductive member for electrophotography according to claim 8, wherein the intermediate layer has a thickness of 1 to 5 μm.

16. An electro-conductive member for electrophotography according to claim 8, wherein the resin particles forming the skeleton each contains a radiation degradable resin.

17. An electro-conductive member for electrophotography according to claim 8, further comprising a rigid structure configured to protect the surface layer.

18. A process cartridge, which is removably mounted onto a main body of an electrophotographic apparatus, the process cartridge comprising:

(i) an electrophotographic photosensitive member; and (ii) a charging member configured to charge the electrophotographic photosensitive member, the charging member comprising an electro-conductive member for electrophotography comprising:

(i) an electro-conductive support; and (ii) a surface layer formed on the electro-conductive support, the surface layer having a three-dimensionally continuous skeleton and pores communicating in a thickness direction thereof, wherein when an arbitrary 150-micrometer square region of a surface of the surface layer is photographed and the region is equally divided into 3,600 squares by two sets of lines at right angles, a number of squares each including a through-hole is 100 or less, the skeleton is non-electro-conductive and includes a plurality of resin particles bonded to each other through necks, the resin particles each contain a radiation degradable resin comprising at least one selected from the group consisting of polyisobutylene, poly(α-methylstyrene), polybutyl methacrylate, polyisobutyl methacrylate and polyacetal, and an average D1 of circle-equivalent diameters of the resin particles is 0.1 to 20 μm.

19. An electrophotographic image forming apparatus, comprising:

(i) an electrophotographic photosensitive member; and (ii) a charging member configured to charge the electrophotographic photosensitive member, the charging member comprising an electro-conductive member for electrophotography comprising:

(i) an electro-conductive support; and (ii) a surface layer formed on the electro-conductive support, the surface layer having a three-dimensionally continuous skeleton and pores communicating in a thickness direction thereof, wherein when an arbitrary 150-micrometer square region of a surface of the surface layer is photographed and the region is equally divided into 3,600 squares by lines at right angles, a number of squares each including a through-hole is 100 or less, the skeleton is non-electro-conductive and includes a plurality of resin particles bonded to each other through necks, the resin particles each contain a radiation degradable resin comprising at least one selected from the group consisting of polyisobutylene, poly(α-methylstyrene), polybutyl methacrylate, polyisobutyl methacrylate and polyacetal, and an average D1 of circle-equivalent diameters of the resin particles is 0.1 to 20 μm.

20. An electro-conductive member for electrophotography according to claim 1, wherein the radiation degradable resin comprises polyisobutylene.

21. An electro-conductive member for electrophotography according to claim 1, wherein the radiation degradable resin comprises poly(α-methyl styrene).

22. An electro-conductive member for electrophotography according to claim 1, wherein the radiation degradable resin comprises polyacetal.

* * * * *